US011511536B2

(12) United States Patent
Burkatovsky

(10) Patent No.: US 11,511,536 B2
(45) Date of Patent: Nov. 29, 2022

(54) CALIBRATION OF RUNOUT ERROR IN A DIGITAL PRINTING SYSTEM

(71) Applicant: LANDA CORPORATION LTD., Rehovot (IL)

(72) Inventor: Vitaly Burkatovsky, Rishon Lezion (IL)

(73) Assignee: LANDA CORPORATION LTD., Rehovot (IL)

( * ) Notice: Subject to any disclaimer, the term of this patent is extended or adjusted under 35 U.S.C. 154(b) by 303 days.

(21) Appl. No.: 16/765,878

(22) PCT Filed: Nov. 13, 2018

(86) PCT No.: PCT/IB2018/058895
§ 371 (c)(1),
(2) Date: May 21, 2020

(87) PCT Pub. No.: WO2019/102297
PCT Pub. Date: May 31, 2019

(65) Prior Publication Data

US 2020/0361202 A1 Nov. 19, 2020

Related U.S. Application Data

(60) Provisional application No. 62/590,672, filed on Nov. 27, 2017.

(51) Int. Cl.
*B41J 2/005* (2006.01)
*B41J 3/46* (2006.01)
(Continued)

(52) U.S. Cl.
CPC ..... *B41J 2/0057* (2013.01); *B41J 3/46* (2013.01); *B41J 11/008* (2013.01); *B41J 11/13* (2013.01)

(58) Field of Classification Search
CPC . B41J 2/0057; B41J 3/46; B41J 11/008; B41J 11/13
See application file for complete search history.

(56) References Cited

U.S. PATENT DOCUMENTS 2,839,181 A 6/1958 Renner
3,011,545 A 12/1961 Welsh et al.
(Continued)

FOREIGN PATENT DOCUMENTS

CN 1121033 A 4/1996
CN 1200085 A 11/1998
(Continued)

OTHER PUBLICATIONS

"Amino Functional Silicone Polymers", in Xiameter.COPYRGT. 2009 Dow Coming Corporation.
(Continued)

*Primary Examiner* — Henok D Legesse
(74) *Attorney, Agent, or Firm* — Kligler & Associates Patent Attorneys Ltd

(57) ABSTRACT

Printing apparatus (20) includes a continuous blanket (24) and a set of motorized rollers (31), which advance the blanket at a constant speed through an image area. One or more print bars (38) eject droplets of ink at respective locations onto the blanket in the image area. One or more monitoring rollers (42), in proximity to the locations of the print bars, contact the blanket so as to be rotated by advancement of the blanket. Each monitoring roller includes an encoder (44), which outputs a signal indicative of a rotation angle of the monitoring roller. A control unit (40) collects, during a calibration phase, the signal from the encoders over multiple rotations of the monitoring rollers and computes runout correction factors. During an operational phase, the control unit synchronizes ejection of the
(Continued)

droplets from the print bars using the computed runout correction factors.

14 Claims, 3 Drawing Sheets

(51) Int. Cl.
*B41J 11/00* (2006.01)
*B41J 11/13* (2006.01)

(56) References Cited

U.S. PATENT DOCUMENTS 3,053,319 A 9/1962 Cronin et al.
3,697,551 A 10/1972 Thomson
3,697,568 A 10/1972 Boissieras et al.
3,889,802 A 6/1975 Jonkers
3,898,670 A 8/1975 Erikson et al.
3,947,113 A 3/1976 Buchan et al.
4,009,958 A 3/1977 Kurita et al.
4,093,764 A 6/1978 Duckett et al.
4,293,866 A 10/1981 Takita et al.
4,401,500 A 8/1983 Hamada et al.
4,535,694 A 8/1985 Fukuda
4,538,156 A 8/1985 Durkee et al.
4,555,437 A 11/1985 Tanck
4,575,465 A 3/1986 Viola
4,586,807 A 5/1986 Yuasa
4,642,654 A 2/1987 Toganoh et al.
4,853,737 A 8/1989 Hartley et al.
4,976,197 A 12/1990 Yamanari et al.
5,012,072 A 4/1991 Martin et al.
5,039,339 A 8/1991 Phan et al.
5,062,364 A 11/1991 Lewis et al.
5,075,731 A 12/1991 Kamimura et al.
5,099,256 A 3/1992 Anderson
5,106,417 A 4/1992 Hauser et al.
5,128,091 A 7/1992 Agur et al.
5,190,582 A 3/1993 Shinozuka et al.
5,198,835 A 3/1993 Ando et al.
5,246,100 A 9/1993 Stone et al.
5,264,904 A 11/1993 Audi et al.
5,305,099 A 4/1994 Morcos
5,320,214 A 6/1994 Kordis
5,333,771 A 8/1994 Cesario
5,349,905 A 9/1994 Taylor et al.
5,352,507 A 10/1994 Bresson et al.
5,365,324 A 11/1994 Gu et al.
5,406,884 A 4/1995 Okuda et al.
5,471,233 A 11/1995 Okamoto et al.
5,532,314 A 7/1996 Sexsmith
5,552,875 A 9/1996 Sagiv et al.
5,575,873 A 11/1996 Pieper et al.
5,587,779 A 12/1996 Heeren et al.
5,608,004 A 3/1997 Toyoda et al.
5,613,669 A 3/1997 Grueninger
5,614,933 A 3/1997 Hindman et al.
5,623,296 A 4/1997 Fujino et al.
5,642,141 A 6/1997 Hale et al.
5,660,108 A 8/1997 Pensavecchia
5,677,719 A 10/1997 Granzow
5,679,463 A 10/1997 Visser et al.
5,683,841 A 11/1997 Kato
5,698,018 A 12/1997 Bishop et al.
5,723,242 A 3/1998 Woo et al.
5,733,698 A 3/1998 Lehman et al.
5,736,250 A 4/1998 Heeks et al.
5,772,746 A 6/1998 Sawada et al.
5,777,576 A 7/1998 Zur et al.
5,777,650 A 7/1998 Blank
5,780,412 A 7/1998 Scarborough et al.
5,841,456 A 11/1998 Takei et al.
5,859,076 A 1/1999 Kozma et al.
5,865,299 A 2/1999 Williams
5,880,214 A 3/1999 Okuda
5,883,144 A 3/1999 Bambara et al.
5,883,145 A 3/1999 Hurley et al.
5,884,559 A 3/1999 Okubo et al.
5,889,534 A 3/1999 Johnson et al.
5,891,934 A 4/1999 Moffatt et al.
5,895,711 A 4/1999 Yamaki et al.
5,902,841 A 5/1999 Jaeger et al.
5,923,929 A 7/1999 Ben et al.
5,929,129 A 7/1999 Feichtinger
5,932,659 A 8/1999 Bambara et al.
5,935,751 A 8/1999 Matsuoka et al.
5,978,631 A 11/1999 Lee
5,978,638 A 11/1999 Tanaka et al.
5,991,590 A 11/1999 Chang et al.
6,004,647 A 12/1999 Bambara et al.
6,009,284 A 12/1999 Weinberger et al.
6,024,018 A 2/2000 Darel et al.
6,024,786 A 2/2000 Gore
6,033,049 A 3/2000 Fukuda
6,045,817 A 4/2000 Ananthapadmanabhan et al.
6,053,438 A 4/2000 Romano, Jr. et al.
6,055,396 A 4/2000 Pang
6,059,407 A 5/2000 Komatsu et al.
6,071,368 A 6/2000 Boyd et al.
6,072,976 A 6/2000 Kuriyama et al.
6,078,775 A 6/2000 Arai et al.
6,094,558 A 7/2000 Shimizu et al.
6,102,538 A 8/2000 Ochi et al.
6,103,775 A 8/2000 Bambara et al.
6,108,513 A 8/2000 Landa et al.
6,109,746 A 8/2000 Jeanmaire et al.
6,132,541 A 10/2000 Heaton
6,143,807 A 11/2000 Lin et al.
6,166,105 A 12/2000 Santilli et al.
6,195,112 B1 2/2001 Fassler et al.
6,196,674 B1 3/2001 Takemoto
6,213,580 B1 4/2001 Segerstrom et al.
6,214,894 B1 4/2001 Bambara et al.
6,221,928 B1 4/2001 Kozma et al.
6,234,625 B1 5/2001 Wen
6,242,503 B1 6/2001 Kozma et al.
6,257,716 B1 7/2001 Yanagawa et al.
6,261,688 B1 7/2001 Kaplan et al.
6,262,137 B1 7/2001 Kozma et al.
6,262,207 B1 7/2001 Rao et al.
6,303,215 B1 10/2001 Sonobe et al.
6,316,512 B1 11/2001 Bambara et al.
6,318,853 B1 11/2001 Asano et al.
6,332,943 B1 12/2001 Herrmann et al.
6,335,046 B1 1/2002 Mackey
6,354,700 B1 3/2002 Roth
6,357,869 B1 3/2002 Rasmussen et al.
6,357,870 B1 3/2002 Beach et al.
6,358,660 B1 3/2002 Agler et al.
6,363,234 B2 3/2002 Landa et al.
6,364,451 B1 4/2002 Silverbrook
6,377,772 B1 4/2002 Chowdry et al.
6,383,278 B1 5/2002 Hirasa et al.
6,386,697 B1 5/2002 Yamamoto et al.
6,390,617 B1 5/2002 Iwao
6,396,528 B1 5/2002 Yanagawa
6,397,034 B1 5/2002 Tarnawskyj et al.
6,400,913 B1 6/2002 De et al.
6,402,317 B2 6/2002 Yanagawa et al.
6,405,006 B1 6/2002 Tabuchi
6,409,331 B1 6/2002 Gelbart
6,432,501 B1 8/2002 Yang et al.
6,438,352 B1 8/2002 Landa et al.
6,454,378 B1 9/2002 Silverbrook et al.
6,471,803 B1 10/2002 Pelland et al.
6,530,321 B2 3/2003 Andrew et al.
6,530,657 B2 3/2003 Polierer
6,531,520 B1 3/2003 Bambara et al.
6,551,394 B2 4/2003 Hirasa et al.
6,551,716 B1 4/2003 Landa et al.
6,554,189 B1 4/2003 Good et al.
6,559,969 B1 5/2003 Lapstun
6,575,547 B2 6/2003 Sakuma
6,586,100 B1 7/2003 Pickering et al.

(56) References Cited

U.S. PATENT DOCUMENTS

| | | | |
|---|---|---|---|
| 6,590,012 | B2 | 7/2003 | Miyabayashi |
| 6,608,979 | B1 | 8/2003 | Landa et al. |
| 6,623,817 | B1 | 9/2003 | Yang et al. |
| 6,630,047 | B2 | 10/2003 | Jing et al. |
| 6,633,735 | B2 | 10/2003 | Kellie et al. |
| 6,639,527 | B2 | 10/2003 | Johnson |
| 6,648,468 | B2 | 11/2003 | Shinkoda et al. |
| 6,678,068 | B1 | 1/2004 | Richter et al. |
| 6,682,189 | B2 | 1/2004 | May et al. |
| 6,685,769 | B1 | 2/2004 | Karl et al. |
| 6,704,535 | B2 | 3/2004 | Kobayashi et al. |
| 6,709,096 | B1 | 3/2004 | Beach et al. |
| 6,716,562 | B2 | 4/2004 | Uehara et al. |
| 6,719,423 | B2 | 4/2004 | Chowdry et al. |
| 6,720,367 | B2 | 4/2004 | Taniguchi et al. |
| 6,755,519 | B2 | 6/2004 | Gelbart et al. |
| 6,761,446 | B2 | 7/2004 | Chowdry et al. |
| 6,770,331 | B1 | 8/2004 | Mielke et al. |
| 6,789,887 | B2 | 9/2004 | Yang et al. |
| 6,811,840 | B1 | 11/2004 | Cross |
| 6,827,018 | B1 | 12/2004 | Hartmann et al. |
| 6,881,458 | B2 | 4/2005 | Ludwig et al. |
| 6,898,403 | B2 | 5/2005 | Baker et al. |
| 6,912,952 | B1 | 7/2005 | Landa et al. |
| 6,916,862 | B2 | 7/2005 | Ota et al. |
| 6,917,437 | B1 | 7/2005 | Myers et al. |
| 6,966,712 | B2 | 11/2005 | Trelewicz et al. |
| 6,970,674 | B2 | 11/2005 | Sato et al. |
| 6,974,022 | B2 | 12/2005 | Saeki |
| 6,982,799 | B2 | 1/2006 | Lapstun |
| 6,983,692 | B2 | 1/2006 | Beauchamp et al. |
| 7,025,453 | B2 | 4/2006 | Ylitalo et al. |
| 7,057,760 | B2 | 6/2006 | Lapstun et al. |
| 7,084,202 | B2 | 8/2006 | Pickering et al. |
| 7,128,412 | B2 | 10/2006 | King et al. |
| 7,129,858 | B2 | 10/2006 | Ferran et al. |
| 7,134,953 | B2 | 11/2006 | Reinke |
| 7,160,377 | B2 | 1/2007 | Zoch et al. |
| 7,204,584 | B2 | 4/2007 | Lean et al. |
| 7,213,900 | B2 | 5/2007 | Ebihara |
| 7,224,478 | B1 | 5/2007 | Lapstun et al. |
| 7,265,819 | B2 | 9/2007 | Raney |
| 7,271,213 | B2 | 9/2007 | Hoshida et al. |
| 7,296,882 | B2 | 11/2007 | Buehler et al. |
| 7,300,133 | B1 | 11/2007 | Folkins et al. |
| 7,300,147 | B2 | 11/2007 | Johnson |
| 7,304,753 | B1 | 12/2007 | Richter et al. |
| 7,322,689 | B2 | 1/2008 | Kohne et al. |
| 7,334,520 | B2 | 2/2008 | Geissler et al. |
| 7,348,368 | B2 | 3/2008 | Kakiuchi et al. |
| 7,360,887 | B2 | 4/2008 | Konno |
| 7,362,464 | B2 | 4/2008 | Kitazawa |
| 7,459,491 | B2 | 12/2008 | Tyvoll et al. |
| 7,527,359 | B2 | 5/2009 | Stevenson et al. |
| 7,575,314 | B2 | 8/2009 | Desie et al. |
| 7,612,125 | B2 | 11/2009 | Muller et al. |
| 7,655,707 | B2 | 2/2010 | Ma |
| 7,655,708 | B2 | 2/2010 | House et al. |
| 7,699,922 | B2 | 4/2010 | Breton et al. |
| 7,708,371 | B2 | 5/2010 | Yamanobe |
| 7,709,074 | B2 | 5/2010 | Uchida et al. |
| 7,712,890 | B2 | 5/2010 | Yahiro |
| 7,732,543 | B2 | 6/2010 | Loch et al. |
| 7,732,583 | B2 | 6/2010 | Annoura et al. |
| 7,808,670 | B2 | 10/2010 | Lapstun et al. |
| 7,810,922 | B2 | 10/2010 | Gervasi et al. |
| 7,845,788 | B2 | 12/2010 | Oku |
| 7,867,327 | B2 | 1/2011 | Sano et al. |
| 7,876,345 | B2 | 1/2011 | Houjou |
| 7,910,183 | B2 | 3/2011 | Wu |
| 7,919,544 | B2 | 4/2011 | Matsuyama et al. |
| 7,942,516 | B2 | 5/2011 | Ohara et al. |
| 7,977,408 | B2 | 7/2011 | Matsuyama et al. |
| 7,985,784 | B2 | 7/2011 | Kanaya et al. |
| 8,002,400 | B2 | 8/2011 | Kibayashi et al. |
| 8,012,538 | B2 | 9/2011 | Yokouchi |
| 8,025,389 | B2 | 9/2011 | Yamanobe et al. |
| 8,038,284 | B2 | 10/2011 | Hori et al. |
| 8,041,275 | B2 | 10/2011 | Soria et al. |
| 8,042,906 | B2 | 10/2011 | Chiwata et al. |
| 8,059,309 | B2 | 11/2011 | Lapstun et al. |
| 8,095,054 | B2 | 1/2012 | Nakamura |
| 8,109,595 | B2 | 2/2012 | Tanaka et al. |
| 8,119,315 | B1 | 2/2012 | Heuft et al. |
| 8,122,846 | B2 | 2/2012 | Stiblert et al. |
| 8,147,055 | B2 | 4/2012 | Cellura et al. |
| 8,162,428 | B2 | 4/2012 | Eun et al. |
| 8,177,351 | B2 | 5/2012 | Taniuchi et al. |
| 8,186,820 | B2 | 5/2012 | Chiwata |
| 8,192,904 | B2 | 6/2012 | Nagai et al. |
| 8,215,762 | B2 | 7/2012 | Ageishi |
| 8,242,201 | B2 | 8/2012 | Goto et al. |
| 8,256,857 | B2 | 9/2012 | Folkins et al. |
| 8,263,683 | B2 | 9/2012 | Gibson et al. |
| 8,264,135 | B2 | 9/2012 | Ozolins et al. |
| 8,295,733 | B2 | 10/2012 | Imoto |
| 8,303,071 | B2 | 11/2012 | Eun |
| 8,303,072 | B2 | 11/2012 | Shibata et al. |
| 8,304,043 | B2 | 11/2012 | Nagashima et al. |
| 8,353,589 | B2 | 1/2013 | Ikeda et al. |
| 8,434,847 | B2 | 5/2013 | Dejong et al. |
| 8,460,450 | B2 | 6/2013 | Taverizatshy et al. |
| 8,469,476 | B2 | 6/2013 | Mandel et al. |
| 8,474,963 | B2 | 7/2013 | Hasegawa et al. |
| 8,536,268 | B2 | 9/2013 | Karjala et al. |
| 8,546,466 | B2 | 10/2013 | Yamashita et al. |
| 8,556,400 | B2 | 10/2013 | Yatake et al. |
| 8,693,032 | B2 | 4/2014 | Goddard et al. |
| 8,711,304 | B2 | 4/2014 | Mathew et al. |
| 8,714,731 | B2 | 5/2014 | Leung et al. |
| 8,746,873 | B2 | 6/2014 | Tsukamoto et al. |
| 8,779,027 | B2 | 7/2014 | Idemura et al. |
| 8,802,221 | B2 | 8/2014 | Noguchi et al. |
| 8,867,097 | B2 | 10/2014 | Mizuno |
| 8,885,218 | B2 | 11/2014 | Hirose |
| 8,891,128 | B2 | 11/2014 | Yamazaki |
| 8,894,198 | B2 | 11/2014 | Hook et al. |
| 8,919,946 | B2 | 12/2014 | Suzuki et al. |
| 9,004,629 | B2 | 4/2015 | De et al. |
| 9,186,884 | B2 | 11/2015 | Landa et al. |
| 9,207,585 | B2 | 12/2015 | Hatano et al. |
| 9,227,429 | B1 | 1/2016 | LeStrange et al. |
| 9,229,664 | B2 | 1/2016 | Landa et al. |
| 9,264,559 | B2 | 2/2016 | Motoyanagi et al. |
| 9,284,469 | B2 | 3/2016 | Song et al. |
| 9,290,016 | B2 | 3/2016 | Landa et al. |
| 9,327,496 | B2 | 5/2016 | Landa et al. |
| 9,327,519 | B1 | 5/2016 | Larson et al. |
| 9,353,273 | B2 | 5/2016 | Landa et al. |
| 9,381,736 | B2 | 7/2016 | Landa et al. |
| 9,446,586 | B2 | 9/2016 | Matos et al. |
| 9,498,946 | B2 | 11/2016 | Landa et al. |
| 9,505,208 | B2 | 11/2016 | Shmaiser et al. |
| 9,517,618 | B2 | 12/2016 | Landa et al. |
| 9,566,780 | B2 | 2/2017 | Landa et al. |
| 9,568,862 | B2 | 2/2017 | Shmaiser et al. |
| 9,643,400 | B2 | 5/2017 | Landa et al. |
| 9,643,403 | B2 | 5/2017 | Landa et al. |
| 9,776,391 | B2 | 10/2017 | Landa et al. |
| 9,782,993 | B2 | 10/2017 | Landa et al. |
| 9,849,667 | B2 | 12/2017 | Landa et al. |
| 9,884,479 | B2 | 2/2018 | Landa et al. |
| 9,902,147 | B2 | 2/2018 | Shmaiser et al. |
| 9,914,316 | B2 | 3/2018 | Landa et al. |
| 10,065,411 | B2 | 9/2018 | Landa et al. |
| 10,175,613 | B2 | 1/2019 | Watanabe |
| 10,179,447 | B2 | 1/2019 | Shmaiser et al. |
| 10,190,012 | B2 | 1/2019 | Landa et al. |
| 10,195,843 | B2 | 2/2019 | Landa et al. |
| 10,201,968 | B2 | 2/2019 | Landa et al. |
| 10,226,920 | B2 | 3/2019 | Shmaiser et al. |
| 10,266,711 | B2 | 4/2019 | Landa et al. |
| 10,300,690 | B2 | 5/2019 | Landa et al. |
| 10,357,963 | B2 | 7/2019 | Landa et al. |

(56) References Cited

U.S. PATENT DOCUMENTS 10,357,985 B2 7/2019 Landa et al.
10,427,399 B2 10/2019 Shmaiser et al.
10,434,761 B2 10/2019 Landa et al.
10,477,188 B2 11/2019 Stiglic et al.
10,518,526 B2 12/2019 Landa et al.
10,569,532 B2 2/2020 Shmaiser et al.
10,569,533 B2 2/2020 Landa et al.
10,569,534 B2 2/2020 Shmaiser et al.
10,576,734 B2 3/2020 Landa et al.
10,596,804 B2 3/2020 Landa et al.
10,632,740 B2 4/2020 Landa et al.
10,642,198 B2 5/2020 Landa et al.
10,703,094 B2 7/2020 Shmaiser et al.
2001/0022607 A1 9/2001 Takahashi et al.
2001/0033688 A1 10/2001 Taylor
2002/0041317 A1 4/2002 Kashiwazaki et al.
2002/0061451 A1 5/2002 Kita et al.
2002/0064404 A1 5/2002 Iwai
2002/0102374 A1 8/2002 Gervasi et al.
2002/0121220 A1 9/2002 Lin
2002/0150408 A1 10/2002 Mosher et al.
2002/0164494 A1 11/2002 Grant et al.
2002/0197481 A1 12/2002 Jing et al.
2003/0004025 A1 1/2003 Okuno et al.
2003/0007055 A1 1/2003 Ogawa
2003/0018119 A1 1/2003 Frenkel et al.
2003/0030686 A1 2/2003 Abe et al.
2003/0032700 A1 2/2003 Morrison et al.
2003/0041777 A1 3/2003 Karl et al.
2003/0043258 A1 3/2003 Kerr et al.
2003/0054139 A1 3/2003 Ylitalo et al.
2003/0055129 A1 3/2003 Alford
2003/0063179 A1 4/2003 Adachi
2003/0064317 A1 4/2003 Bailey et al.
2003/0081964 A1 5/2003 Shimura et al.
2003/0118381 A1 6/2003 Law et al.
2003/0129435 A1 7/2003 Blankenship et al.
2003/0186147 A1 10/2003 Pickering et al.
2003/0214568 A1 11/2003 Nishikawa et al.
2003/0234849 A1 12/2003 Pan et al.
2004/0003863 A1 1/2004 Eckhardt
2004/0020382 A1 2/2004 McLean et al.
2004/0036758 A1 2/2004 Sasaki et al.
2004/0047666 A1 3/2004 Imaizumi et al.
2004/0087707 A1 5/2004 Zoch et al.
2004/0123761 A1 7/2004 Szumla et al.
2004/0125188 A1 7/2004 Szumla et al.
2004/0145643 A1 7/2004 Nakamura
2004/0173111 A1 9/2004 Okuda
2004/0200369 A1 10/2004 Brady
2004/0221943 A1 11/2004 Yu et al.
2004/0228642 A1 11/2004 Iida et al.
2004/0246324 A1 12/2004 Nakashima
2004/0246326 A1 12/2004 Dwyer et al.
2004/0252175 A1 12/2004 Bejat et al.
2004/0265016 A1 12/2004 Kitani et al.
2005/0031807 A1 2/2005 Quintens et al.
2005/0082146 A1 4/2005 Axmann
2005/0110855 A1 5/2005 Taniuchi et al.
2005/0111861 A1 5/2005 Calamita et al.
2005/0134874 A1 6/2005 Overall et al.
2005/0150408 A1 7/2005 Hesterman
2005/0185009 A1 8/2005 Claramunt et al.
2005/0195235 A1 9/2005 Kitao
2005/0235870 A1 10/2005 Ishihara
2005/0266332 A1 12/2005 Pavlisko et al.
2005/0272334 A1 12/2005 Wang et al.
2006/0004123 A1 1/2006 Wu et al.
2006/0066704 A1 3/2006 Nishida
2006/0120740 A1 6/2006 Yamada et al.
2006/0135709 A1 6/2006 Hasegawa et al.
2006/0164488 A1 7/2006 Taniuchi et al.
2006/0164489 A1 7/2006 Vega et al.
2006/0192827 A1 8/2006 Takada et al.
2006/0233578 A1 10/2006 Maki et al.
2006/0286462 A1 12/2006 Jackson et al.
2007/0014595 A1 1/2007 Kawagoe
2007/0025768 A1 2/2007 Komatsu et al.
2007/0029171 A1 2/2007 Nemedi
2007/0045939 A1 3/2007 Toya et al.
2007/0054981 A1 3/2007 Yanagi et al.
2007/0064077 A1 3/2007 Konno
2007/0077520 A1 4/2007 Maemoto
2007/0120927 A1 5/2007 Snyder et al.
2007/0123642 A1 5/2007 Banning et al.
2007/0134030 A1 6/2007 Lior et al.
2007/0144368 A1 6/2007 Barazani et al.
2007/0146462 A1 6/2007 Taniuchi et al.
2007/0147894 A1 6/2007 Yokota et al.
2007/0166071 A1 7/2007 Shima
2007/0176995 A1 8/2007 Kadomatsu et al.
2007/0189819 A1 8/2007 Uehara et al.
2007/0199457 A1 8/2007 Cyman, Jr. et al.
2007/0229639 A1 10/2007 Yahiro
2007/0253726 A1 11/2007 Kagawa
2007/0257955 A1 11/2007 Tanaka et al.
2007/0285486 A1 12/2007 Harris et al.
2008/0006176 A1 1/2008 Houjou
2008/0030536 A1 2/2008 Furukawa et al.
2008/0032072 A1 2/2008 Taniuchi et al.
2008/0044587 A1 2/2008 Maeno et al.
2008/0055356 A1 3/2008 Yamanobe
2008/0055381 A1 3/2008 Doi et al.
2008/0074462 A1 3/2008 Hirakawa
2008/0112912 A1 5/2008 Springob et al.
2008/0124158 A1 5/2008 Folkins
2008/0138546 A1 6/2008 Soria et al.
2008/0166495 A1 7/2008 Maeno et al.
2008/0167185 A1 7/2008 Hirota
2008/0175612 A1 7/2008 Oikawa et al.
2008/0196612 A1 8/2008 Rancourt et al.
2008/0196621 A1 8/2008 Ikuno et al.
2008/0213548 A1 9/2008 Koganehira et al.
2008/0236480 A1 10/2008 Furukawa et al.
2008/0253812 A1 10/2008 Pearce et al.
2009/0022504 A1 1/2009 Kuwabara et al.
2009/0041515 A1 2/2009 Kim
2009/0041932 A1 2/2009 Ishizuka et al.
2009/0064884 A1 3/2009 Hook et al.
2009/0074492 A1 3/2009 Ito
2009/0082503 A1 3/2009 Yanagi et al.
2009/0087565 A1 4/2009 Houjou
2009/0098385 A1 4/2009 Kaemper et al.
2009/0116885 A1 5/2009 Ando
2009/0148200 A1 6/2009 Hara et al.
2009/0165937 A1 7/2009 Inoue et al.
2009/0185204 A1 7/2009 Wu et al.
2009/0190951 A1 7/2009 Torimaru et al.
2009/0202275 A1 8/2009 Nishida et al.
2009/0211490 A1 8/2009 Ikuno et al.
2009/0220873 A1 9/2009 Enomoto et al.
2009/0237479 A1 9/2009 Yamashita et al.
2009/0256896 A1 10/2009 Scarlata
2009/0279170 A1 11/2009 Miyazaki et al.
2009/0315926 A1 12/2009 Yamanobe
2009/0317555 A1 12/2009 Hori
2009/0318591 A1 12/2009 Ageishi et al.
2010/0012023 A1 1/2010 Lefevre et al.
2010/0053292 A1 3/2010 Thayer et al.
2010/0053293 A1 3/2010 Thayer et al.
2010/0066796 A1 3/2010 Yanagi et al.
2010/0075843 A1 3/2010 Ikuno et al.
2010/0086692 A1 4/2010 Ohta et al.
2010/0091064 A1 4/2010 Araki et al.
2010/0225695 A1 9/2010 Fujikura
2010/0231623 A1 9/2010 Hirato
2010/0239789 A1 9/2010 Umeda
2010/0245511 A1 9/2010 Ageishi
2010/0247171 A1 9/2010 Ono et al.
2010/0282100 A1 11/2010 Okuda et al.
2010/0285221 A1 11/2010 Oki et al.
2010/0300604 A1 12/2010 Goss et al.
2010/0303504 A1 12/2010 Funamoto et al.
2010/0310281 A1 12/2010 Miura et al.

(56) References Cited

U.S. PATENT DOCUMENTS

2011/0044724 A1 2/2011 Funamoto et al.
2011/0058001 A1 3/2011 Gila et al.
2011/0058859 A1 3/2011 Nakamatsu et al.
2011/0063355 A1* 3/2011 Eun ..... B41J 29/393 347/16
2011/0069110 A1 3/2011 Matsumoto et al.
2011/0069117 A1 3/2011 Ohzeki et al.
2011/0069129 A1 3/2011 Shimizu
2011/0085828 A1 4/2011 Kosako et al.
2011/0128300 A1 6/2011 Gay et al.
2011/0141188 A1 6/2011 Morita
2011/0149002 A1 6/2011 Kessler
2011/0150509 A1 6/2011 Komiya
2011/0150541 A1 6/2011 Michibata
2011/0169889 A1 7/2011 Kojima et al.
2011/0195260 A1 8/2011 Lee et al.
2011/0199414 A1 8/2011 Lang
2011/0234683 A1 9/2011 Komatsu
2011/0234689 A1 9/2011 Saito
2011/0242181 A1 10/2011 Otobe
2011/0249090 A1 10/2011 Moore et al.
2011/0269885 A1 11/2011 Imai
2011/0279554 A1 11/2011 Dannhauser et al.
2011/0298884 A1 12/2011 Furuta
2011/0304674 A1 12/2011 Sambhy et al.
2012/0013693 A1 1/2012 Tasaka et al.
2012/0013694 A1 1/2012 Kanke
2012/0013928 A1 1/2012 Yoshida et al.
2012/0026224 A1 2/2012 Anthony et al.
2012/0039647 A1 2/2012 Brewington et al.
2012/0094091 A1 4/2012 Van et al.
2012/0098882 A1 4/2012 Onishi et al.
2012/0105561 A1 5/2012 Taniuchi et al.
2012/0105562 A1 5/2012 Sekiguchi et al.
2012/0113180 A1 5/2012 Tanaka et al.
2012/0113203 A1 5/2012 Kushida et al.
2012/0127250 A1 5/2012 Kanasugi et al.
2012/0127251 A1 5/2012 Tsuji et al.
2012/0140009 A1 6/2012 Kanasugi et al.
2012/0154497 A1 6/2012 Nakao et al.
2012/0156375 A1 6/2012 Brust et al.
2012/0156624 A1 6/2012 Rondon et al.
2012/0162302 A1 6/2012 Oguchi et al.
2012/0163846 A1 6/2012 Andoh et al.
2012/0194830 A1 8/2012 Gaertner et al.
2012/0236100 A1 9/2012 Toya
2012/0237260 A1 9/2012 Sengoku et al.
2012/0287260 A1 11/2012 Lu et al.
2012/0301186 A1 11/2012 Yang et al.
2012/0314013 A1 12/2012 Takemoto et al.
2012/0314077 A1 12/2012 Clavenna, II et al.
2013/0011158 A1 1/2013 Meguro et al.
2013/0017006 A1 1/2013 Suda
2013/0044188 A1 2/2013 Nakamura et al.
2013/0057603 A1 3/2013 Gordon
2013/0088543 A1 4/2013 Tsuji et al.
2013/0096871 A1 4/2013 Takahama
2013/0120513 A1 5/2013 Thayer et al.
2013/0182045 A1 7/2013 Ohzeki et al.
2013/0201237 A1 8/2013 Thomson et al.
2013/0234080 A1 9/2013 Torikoshi et al.
2013/0242016 A1 9/2013 Edwards et al.
2013/0302065 A1 11/2013 Mori et al.
2013/0338273 A1 12/2013 Shimanaka et al.
2014/0001013 A1 1/2014 Takifuji et al.
2014/0011125 A1 1/2014 Inoue et al.
2014/0043398 A1 2/2014 Butler et al.
2014/0104360 A1 4/2014 Häcker et al.
2014/0153956 A1 6/2014 Yonemoto
2014/0168330 A1 6/2014 Liu et al.
2014/0175707 A1 6/2014 Wolk et al.
2014/0198162 A1 7/2014 DiRubio et al.
2014/0232782 A1 8/2014 Mukai et al.
2014/0267777 A1 9/2014 Le et al.
2014/0334855 A1 11/2014 Onishi et al.
2014/0339056 A1 11/2014 Iwakoshi et al.
2015/0022605 A1 1/2015 Mantell et al.
2015/0024648 A1 1/2015 Landa et al.
2015/0025179 A1 1/2015 Landa et al.
2015/0072090 A1 3/2015 Landa et al.
2015/0085036 A1 3/2015 Liu et al.
2015/0085037 A1 3/2015 Liu et al.
2015/0085038 A1 3/2015 Liu
2015/0116408 A1 4/2015 Armbruster et al.
2015/0118503 A1 4/2015 Landa et al.
2015/0165758 A1 6/2015 Sambhy et al.
2015/0195509 A1 7/2015 Phipps
2015/0210065 A1 7/2015 Kelly et al.
2015/0304531 A1 10/2015 Rodriguez et al.
2015/0315403 A1 11/2015 Song et al.
2015/0336378 A1 11/2015 Guttmann et al.
2015/0361288 A1 12/2015 Song et al.
2016/0031246 A1 2/2016 Sreekumar et al.
2016/0222232 A1 8/2016 Landa et al.
2016/0250879 A1 9/2016 Chen et al.
2016/0286462 A1 9/2016 Gohite et al.
2016/0375680 A1 12/2016 Nishitani et al.
2016/0378036 A1 12/2016 Onishi et al.
2017/0028688 A1 2/2017 Dannhauser et al.
2017/0104887 A1 4/2017 Nomura
2018/0149998 A1 5/2018 Furukawa
2018/0259888 A1 9/2018 Mitsui et al.
2018/0348672 A1 12/2018 Yoshida
2018/0348675 A1 12/2018 Nakamura et al.
2019/0016114 A1 1/2019 Sugiyama et al.
2019/0023919 A1 1/2019 Landa et al.
2019/0152218 A1 5/2019 Stein et al.
2019/0218411 A1 7/2019 Landa et al.
2019/0256724 A1 8/2019 Landa et al.
2019/0358982 A1 11/2019 Landa et al.
2019/0366705 A1 12/2019 Landa et al.
2019/0389230 A1 12/2019 Landa et al.
2020/0062002 A1 2/2020 Landa et al.
2020/0156366 A1 5/2020 Shmaiser et al.
2020/0171813 A1 6/2020 Chechik et al.
2020/0189264 A1 6/2020 Landa et al.
2020/0198322 A1 6/2020 Landa et al.
2021/0095145 A1 4/2021 Landa et al.
2021/0146697 A1 5/2021 Landa et al.
2021/0182001 A1 6/2021 Levant
2021/0245528 A1 8/2021 Landa et al.
2021/0252876 A1 8/2021 Landa et al.
2021/0260869 A1 8/2021 Landa et al.
2021/0268793 A1 9/2021 Burkatovsky
2021/0283899 A1 9/2021 Landa et al.
2022/0111633 A1 4/2022 Shmaiser et al.
2022/0153015 A1 5/2022 Landa et al.
2022/0153048 A1 5/2022 Landa et al.
2022/0176693 A1 6/2022 Landa et al.
2022/0188050 A1 6/2022 Boris

FOREIGN PATENT DOCUMENTS

CN 1212229 A 3/1999
CN 1305895 A 8/2001
CN 1324901 A 12/2001
CN 1445622 A 10/2003
CN 1493514 A 5/2004
CN 1535235 A 10/2004
CN 1543404 A 11/2004
CN 1555422 A 12/2004
CN 1680506 A 10/2005
CN 1703326 A 11/2005
CN 1720187 A 1/2006
CN 1261831 C 6/2006
CN 1809460 A 7/2006
CN 1289368 C 12/2006
CN 101073937 A 11/2007
CN 101177057 A 5/2008
CN 101249768 A 8/2008
CN 101344746 A 1/2009
CN 101359210 A 2/2009
CN 101508200 A 8/2009
CN 101524916 A 9/2009

(56) References Cited

FOREIGN PATENT DOCUMENTS

| | | | |
|---|---|---|---|
| CN | 101544100 | A | 9/2009 |
| CN | 101544101 | A | 9/2009 |
| CN | 101592896 | A | 12/2009 |
| CN | 101607468 | A | 12/2009 |
| CN | 201410787 | Y | 2/2010 |
| CN | 101820241 | A | 9/2010 |
| CN | 101835611 | A | 9/2010 |
| CN | 101835612 | A | 9/2010 |
| CN | 101873982 | A | 10/2010 |
| CN | 102229294 | A | 11/2011 |
| CN | 102248776 | A | 11/2011 |
| CN | 102300932 | A | 12/2011 |
| CN | 102529257 | A | 7/2012 |
| CN | 102555450 | A | 7/2012 |
| CN | 102648095 | A | 8/2012 |
| CN | 102673209 | A | 9/2012 |
| CN | 102925002 | A | 2/2013 |
| CN | 103045008 | A | 4/2013 |
| CN | 103309213 | A | 9/2013 |
| CN | 103568483 | A | 2/2014 |
| CN | 103627337 | A | 3/2014 |
| CN | 103991293 | A | 8/2014 |
| CN | 104015415 | A | 9/2014 |
| CN | 104220934 | A | 12/2014 |
| CN | 104271356 | A | 1/2015 |
| CN | 104284850 | A | 1/2015 |
| CN | 104618642 | A | 5/2015 |
| CN | 105058999 | A | 11/2015 |
| CN | 107111267 | A | 8/2017 |
| DE | 102010060999 | A1 | 6/2012 |
| EP | 0457551 | A2 | 11/1991 |
| EP | 0499857 | A1 | 8/1992 |
| EP | 0606490 | A1 | 7/1994 |
| EP | 0609076 | A2 | 8/1994 |
| EP | 0613791 | A2 | 9/1994 |
| EP | 0676300 | A2 | 10/1995 |
| EP | 0530627 | B1 | 3/1997 |
| EP | 0784244 | A2 | 7/1997 |
| EP | 0835762 | A1 | 4/1998 |
| EP | 0843236 | A2 | 5/1998 |
| EP | 0854398 | A2 | 7/1998 |
| EP | 1013466 | A2 | 6/2000 |
| EP | 1146090 | A2 | 10/2001 |
| EP | 1158029 | A1 | 11/2001 |
| EP | 0825029 | B1 | 5/2002 |
| EP | 1247821 | A2 | 10/2002 |
| EP | 1271263 | A1 | 1/2003 |
| EP | 0867483 | B1 | 6/2003 |
| EP | 0923007 | B1 | 3/2004 |
| EP | 1454968 | A1 | 9/2004 |
| EP | 1503326 | A1 | 2/2005 |
| EP | 1777243 | A1 | 4/2007 |
| EP | 2028238 | A1 | 2/2009 |
| EP | 2042317 | A1 | 4/2009 |
| EP | 2065194 | A2 | 6/2009 |
| EP | 2228210 | A1 | 9/2010 |
| EP | 2270070 | A1 | 1/2011 |
| EP | 2042318 | B1 | 2/2011 |
| EP | 2042325 | B1 | 2/2012 |
| EP | 2634010 | A1 | 9/2013 |
| EP | 2683556 | A1 | 1/2014 |
| EP | 2075635 | B1 | 10/2014 |
| EP | 3260486 | A1 | 12/2017 |
| EP | 2823363 | B1 | 10/2018 |
| GB | 748821 | A | 5/1956 |
| GB | 1496016 | A | 12/1977 |
| GB | 1520932 | A | 8/1978 |
| GB | 1522175 | A | 8/1978 |
| GB | 2321430 | A | 7/1998 |
| JP | S4843941 | B1 | 12/1973 |
| JP | S5578904 | A | 6/1980 |
| JP | S57121446 | U | 7/1982 |
| JP | S6076343 | A | 4/1985 |
| JP | S60199692 | A | 10/1985 |
| JP | S6223783 | A | 1/1987 |
| JP | H03248170 | A | 11/1991 |
| JP | H05147208 | A | 6/1993 |
| JP | H05192871 | A | 8/1993 |
| JP | H05297737 | A | 11/1993 |
| JP | H06954 | A | 1/1994 |
| JP | H06100807 | A | 4/1994 |
| JP | H06171076 | A | 6/1994 |
| JP | H06345284 | A | 12/1994 |
| JP | H07112841 | A | 5/1995 |
| JP | H07186453 | A | 7/1995 |
| JP | H07238243 | A | 9/1995 |
| JP | H0862999 | A | 3/1996 |
| JP | H08112970 | A | 5/1996 |
| JP | 2529651 | B2 | 8/1996 |
| JP | H09123432 | A | 5/1997 |
| JP | H09157559 | A | 6/1997 |
| JP | H09281851 | A | 10/1997 |
| JP | H09300678 | A | 11/1997 |
| JP | H09314867 | A | 12/1997 |
| JP | H10130597 | A | 5/1998 |
| JP | H1142811 | A | 2/1999 |
| JP | H11503244 | A | 3/1999 |
| JP | H11106081 | A | 4/1999 |
| JP | H11138740 | A | 5/1999 |
| JP | H11245383 | A | 9/1999 |
| JP | 2000108320 | A | 4/2000 |
| JP | 2000108334 | A | 4/2000 |
| JP | 2000141710 | A | 5/2000 |
| JP | 2000168062 | A | 6/2000 |
| JP | 2000169772 | A | 6/2000 |
| JP | 2000206801 | A | 7/2000 |
| JP | 2000343025 | A | 12/2000 |
| JP | 2001088430 | A | 4/2001 |
| JP | 2001098201 | A | 4/2001 |
| JP | 2001139865 | A | 5/2001 |
| JP | 3177985 | B2 | 6/2001 |
| JP | 2001164165 | A | 6/2001 |
| JP | 2001199150 | A | 7/2001 |
| JP | 2001206522 | A | 7/2001 |
| JP | 2002020666 | A | 1/2002 |
| JP | 2002049211 | A | 2/2002 |
| JP | 2002504446 | A | 2/2002 |
| JP | 2002069346 | A | 3/2002 |
| JP | 2002103598 | A | 4/2002 |
| JP | 2002169383 | A | 6/2002 |
| JP | 2002229276 | A | 8/2002 |
| JP | 2002234243 | A | 8/2002 |
| JP | 2002278365 | A | 9/2002 |
| JP | 2002304066 | A | 10/2002 |
| JP | 2002326733 | A | 11/2002 |
| JP | 2002371208 | A | 12/2002 |
| JP | 2003057967 | A | 2/2003 |
| JP | 2003076159 | A | 3/2003 |
| JP | 2003094795 | A | 4/2003 |
| JP | 2003114558 | A | 4/2003 |
| JP | 2003145914 | A | 5/2003 |
| JP | 2003183557 | A | 7/2003 |
| JP | 2003211770 | A | 7/2003 |
| JP | 2003219271 | A | 7/2003 |
| JP | 2003246135 | A | 9/2003 |
| JP | 2003246484 | A | 9/2003 |
| JP | 2003292855 | A | 10/2003 |
| JP | 2003313466 | A | 11/2003 |
| JP | 2004009632 | A | 1/2004 |
| JP | 2004011263 | A | 1/2004 |
| JP | 2004019022 | A | 1/2004 |
| JP | 2004025708 | A | 1/2004 |
| JP | 2004034441 | A | 2/2004 |
| JP | 2004077669 | A | 3/2004 |
| JP | 2004114377 | A | 4/2004 |
| JP | 2004114675 | A | 4/2004 |
| JP | 2004148687 | A | 5/2004 |
| JP | 2004167902 | A | 6/2004 |
| JP | 2004231711 | A | 8/2004 |
| JP | 2004524190 | A | 8/2004 |
| JP | 2004261975 | A | 9/2004 |
| JP | 2004325782 | A | 11/2004 |
| JP | 2004340983 | A | 12/2004 |
| JP | 2005014255 | A | 1/2005 |

(56) References Cited

FOREIGN PATENT DOCUMENTS

| | | | |
|---|---|---|---|
| JP | 2005014256 | A | 1/2005 |
| JP | 2005114769 | A | 4/2005 |
| JP | 2005215247 | A | 8/2005 |
| JP | 2005307184 | A | 11/2005 |
| JP | 2005319593 | A | 11/2005 |
| JP | 2006001688 | A | 1/2006 |
| JP | 2006023403 | A | 1/2006 |
| JP | 2006095870 | A | 4/2006 |
| JP | 2006102975 | A | 4/2006 |
| JP | 2006137127 | A | 6/2006 |
| JP | 2006143778 | A | 6/2006 |
| JP | 2006152133 | A | 6/2006 |
| JP | 2006224583 | A | 8/2006 |
| JP | 2006231666 | A | 9/2006 |
| JP | 2006234212 | A | 9/2006 |
| JP | 2006243212 | A | 9/2006 |
| JP | 2006263984 | A | 10/2006 |
| JP | 2006347081 | A | 12/2006 |
| JP | 2006347085 | A | 12/2006 |
| JP | 2007025246 | A | 2/2007 |
| JP | 2007041530 | A | 2/2007 |
| JP | 2007069584 | A | 3/2007 |
| JP | 2007079159 | A | 3/2007 |
| JP | 2007083445 | A | 4/2007 |
| JP | 2007190745 | A | 8/2007 |
| JP | 2007216673 | A | 8/2007 |
| JP | 2007253347 | A | 10/2007 |
| JP | 2007334125 | A | 12/2007 |
| JP | 2008006816 | A | 1/2008 |
| JP | 2008018716 | A | 1/2008 |
| JP | 2008019286 | A | 1/2008 |
| JP | 2008036968 | A | 2/2008 |
| JP | 2008082820 | A | 4/2008 |
| JP | 2008137146 | A | 6/2008 |
| JP | 2008137239 | A | 6/2008 |
| JP | 2008139877 | A | 6/2008 |
| JP | 2008142962 | A | 6/2008 |
| JP | 2008183744 | A | 8/2008 |
| JP | 2008194997 | A | 8/2008 |
| JP | 2008532794 | A | 8/2008 |
| JP | 2008201564 | A | 9/2008 |
| JP | 2008238674 | A | 10/2008 |
| JP | 2008246787 | A | 10/2008 |
| JP | 2008246990 | A | 10/2008 |
| JP | 2008254203 | A | 10/2008 |
| JP | 2008255135 | A | 10/2008 |
| JP | 2009040892 | A | 2/2009 |
| JP | 2009045794 | A | 3/2009 |
| JP | 2009045851 | A | 3/2009 |
| JP | 2009045885 | A | 3/2009 |
| JP | 2009083314 | A | 4/2009 |
| JP | 2009083317 | A | 4/2009 |
| JP | 2009083325 | A | 4/2009 |
| JP | 2009096175 | A | 5/2009 |
| JP | 2009148908 | A | 7/2009 |
| JP | 2009154330 | A | 7/2009 |
| JP | 2009190375 | A | 8/2009 |
| JP | 2009202355 | A | 9/2009 |
| JP | 2009214318 | A | 9/2009 |
| JP | 2009214439 | A | 9/2009 |
| JP | 2009532240 | A | 9/2009 |
| JP | 2009226805 | A | 10/2009 |
| JP | 2009226852 | A | 10/2009 |
| JP | 2009226886 | A | 10/2009 |
| JP | 2009226890 | A | 10/2009 |
| JP | 2009227909 | A | 10/2009 |
| JP | 2009233977 | A | 10/2009 |
| JP | 2009234219 | A | 10/2009 |
| JP | 2009240925 | A | 10/2009 |
| JP | 2009271422 | A | 11/2009 |
| JP | 2010005815 | A | 1/2010 |
| JP | 2010030300 | A | 2/2010 |
| JP | 2010054855 | A | 3/2010 |
| JP | 2010510357 | A | 4/2010 |
| JP | 2010105365 | A | 5/2010 |
| JP | 2010173201 | A | 8/2010 |
| JP | 2010184376 | A | 8/2010 |
| JP | 2010214885 | A | 9/2010 |
| JP | 4562388 | B2 | 10/2010 |
| JP | 2010228192 | A | 10/2010 |
| JP | 2010228392 | A | 10/2010 |
| JP | 2010234599 | A | 10/2010 |
| JP | 2010234681 | A | 10/2010 |
| JP | 2010240897 | A | 10/2010 |
| JP | 2010241073 | A | 10/2010 |
| JP | 2010247381 | A | 11/2010 |
| JP | 2010247528 | A | 11/2010 |
| JP | 2010258193 | A | 11/2010 |
| JP | 2010260204 | A | 11/2010 |
| JP | 2010260287 | A | 11/2010 |
| JP | 2010260302 | A | 11/2010 |
| JP | 2010286570 | A | 12/2010 |
| JP | 2011002532 | A | 1/2011 |
| JP | 2011025431 | A | 2/2011 |
| JP | 2011031619 | A | 2/2011 |
| JP | 2011037070 | A | 2/2011 |
| JP | 2011064850 | A | 3/2011 |
| JP | 2011067956 | A | 4/2011 |
| JP | 2011126031 | A | 6/2011 |
| JP | 2011133884 | A | 7/2011 |
| JP | 2011144271 | A | 7/2011 |
| JP | 2011523601 | A | 8/2011 |
| JP | 2011168024 | A | 9/2011 |
| JP | 2011173325 | A | 9/2011 |
| JP | 2011173326 | A | 9/2011 |
| JP | 2011186346 | A | 9/2011 |
| JP | 2011189627 | A | 9/2011 |
| JP | 2011201951 | A | 10/2011 |
| JP | 2011224032 | A | 11/2011 |
| JP | 2012042943 | A | 3/2012 |
| JP | 2012086499 | A | 5/2012 |
| JP | 2012111194 | A | 6/2012 |
| JP | 2012126123 | A | 7/2012 |
| JP | 2012139905 | A | 7/2012 |
| JP | 2012196787 | A | 10/2012 |
| JP | 2012201419 | A | 10/2012 |
| JP | 2013001081 | A | 1/2013 |
| JP | 2013060299 | A | 4/2013 |
| JP | 2013103474 | A | 5/2013 |
| JP | 2013104044 | A | 5/2013 |
| JP | 2013121671 | A | 6/2013 |
| JP | 2013129158 | A | 7/2013 |
| JP | 2014008609 | A | 1/2014 |
| JP | 2014047005 | A | 3/2014 |
| JP | 2014073675 | A | 4/2014 |
| JP | 2014094827 | A | 5/2014 |
| JP | 2014131843 | A | 7/2014 |
| JP | 2015202616 | A | 11/2015 |
| JP | 2016074206 | A | 5/2016 |
| JP | 2016093999 | A | 5/2016 |
| JP | 2016185688 | A | 10/2016 |
| JP | 2016539830 | A | 12/2016 |
| JP | 2017093178 | A | 5/2017 |
| RU | 2180675 | C2 | 3/2002 |
| RU | 2282643 | C1 | 8/2006 |
| WO | 8600327 | A1 | 1/1986 |
| WO | 9307000 | A1 | 4/1993 |
| WO | 9604339 | A1 | 2/1996 |
| WO | 9631809 | A1 | 10/1996 |
| WO | 9707991 | A1 | 3/1997 |
| WO | 9736210 | A1 | 10/1997 |
| WO | 9821251 | A1 | 5/1998 |
| WO | 9855901 | A1 | 12/1998 |
| WO | 9912633 | A1 | 3/1999 |
| WO | 9942509 | A1 | 8/1999 |
| WO | 9943502 | A2 | 9/1999 |
| WO | 0064685 | A1 | 11/2000 |
| WO | 0154902 | A1 | 8/2001 |
| WO | 0170512 | A1 | 9/2001 |
| WO | 02068191 | A1 | 9/2002 |
| WO | 02078868 | A2 | 10/2002 |
| WO | 02094912 | A1 | 11/2002 |
| WO | 2004113082 | A1 | 12/2004 |
| WO | 2004113450 | A1 | 12/2004 |

(56) References Cited

FOREIGN PATENT DOCUMENTS

| | | | |
|---|---|---|---|
| WO | 2006051733 | A1 | 5/2006 |
| WO | 2006069205 | A1 | 6/2006 |
| WO | 2006073696 | A1 | 7/2006 |
| WO | 2006091957 | A2 | 8/2006 |
| WO | 2007009871 | A2 | 1/2007 |
| WO | 2007145378 | A1 | 12/2007 |
| WO | 2008078841 | A1 | 7/2008 |
| WO | 2009025809 | A1 | 2/2009 |
| WO | 2009134273 | A1 | 11/2009 |
| WO | 2010042784 | A3 | 7/2010 |
| WO | 2010073916 | A1 | 7/2010 |
| WO | 2011142404 | A1 | 11/2011 |
| WO | 2012014825 | A1 | 2/2012 |
| WO | 2012148421 | A1 | 11/2012 |
| WO | 2013060377 | A1 | 5/2013 |
| WO | 2013087249 | A1 | 6/2013 |
| WO | 2013132339 | A1 | 9/2013 |
| WO | 2013132340 | A1 | 9/2013 |
| WO | 2013132343 | A1 | 9/2013 |
| WO | 2013132345 | A1 | 9/2013 |
| WO | 2013132356 | A1 | 9/2013 |
| WO | 2013132418 | A2 | 9/2013 |
| WO | 2013132419 | A1 | 9/2013 |
| WO | 2013132420 | A1 | 9/2013 |
| WO | 2013132424 | A1 | 9/2013 |
| WO | 2013132432 | A1 | 9/2013 |
| WO | 2013132438 | A2 | 9/2013 |
| WO | 2013132439 | A1 | 9/2013 |
| WO | 2013136220 | A1 | 9/2013 |
| WO | 2015026864 | A1 | 2/2015 |
| WO | 2015036864 | A1 | 3/2015 |
| WO | 2015036906 | A1 | 3/2015 |
| WO | 2015036960 | A1 | 3/2015 |
| WO | 2016166690 | A1 | 10/2016 |
| WO | 2017208246 | A1 | 12/2017 |
| WO | 2018100541 | A1 | 6/2018 |

OTHER PUBLICATIONS

BASF , "JONCRYL 537", Datasheet, Retrieved from the internet: Mar. 23, 2007 p. 1.
Clariant., "Ultrafine Pigment Dispersion for Design and Creative Materials: Hostafine Pigment Preparation" Jun. 19, 2008. Retrieved from the Internet: [URL: http://www.clariant.com/C125720D002B963C/4352D0BC052E90CEC1257479002707D9/$FILE/DP6208E_0608_FL_Hostafinefordesignandcreativematerials.pdf].
CN101073937A Machine Translation (by EPO and Google)—published Nov. 21, 2007; Werner Kaman Maschinen GMBH & [DE].
CN101177057 Machine Translation (by EPO and Google)—published May 14, 2008—Hangzhou Yuanyang Industry Co.
CN101249768A Machine Translation (by EPO and Google)—published Aug. 27, 2008; Shantou Xinxie Special Paper T [CN].
CN101344746A Machine Translation (by EPO and Google)—published Jan. 14, 2009; Ricoh KK [JP].
CN101359210A Machine Translation (by EPO and Google)—published Feb. 4, 2009; Canon KK [JP].
CN101524916A Machine Translation (by EPO and Google)—published Sep. 9, 2009; Fuji Xerox Co Ltd.
CN101544100A Machine Translation (by EPO and Google)—published Sep. 30, 2009; Fuji Xerox Co Ltd.
CN101873982A Machine Translation (by EPO and Google)—published Oct. 27, 2010; Habasit AG, Delair et al.
CN102648095A Machine Translation (by EPO and Google)—published Aug. 22, 2012; Mars Inc.
CN102925002 Machine Translation (by EPO and Google)—published Feb. 13, 2013; Jiangnan University, Fu et al.
CN103045008A Machine Translation (by EPO and Google)—published Apr. 17,2 013; Fuji Xerox Co Ltd.
CN103991293A Machine Translation (by EPO and Google)—published Aug. 20, 2014; Miyakoshi Printing Machinery Co., Ltd, Junichi et al.
CN104618642 Machine Translation (by EPO and Google); published on May 13, 2015, Yulong Comp Comm Tech Shenzhen.
CN105058999A Machine Translation (by EPO and Google)—published Nov. 18, 2015; Zhuoli Imaging Technology Co Ltd.
CN1121033A Machine Translation (by EPO and Google)—published Apr. 24, 1996; Kuehnle Manfred R [US].
CN1212229A Machine Translation (by EPO and Google)—published Mar. 31, 1999; Honta Industry Corp [JP].
CN1493514A Machine Translation (by EPO and Google)—published May 5, 2004; GD Spa, Boderi et al.
CN1809460A Machine Translation (by EPO and Google)—published Jul. 26, 2006; Canon KK.
CN201410787Y Machine Translation (by EPO and Google)—published Feb. 24, 2010; Zhejiang Chanx Wood Co Ltd.
Co-pending U.S. Appl. No. 16/512,915, filed Jul. 16, 2019.
Co-pending U.S. Appl. No. 16/590,397, filed Oct. 2, 2019.
Co-pending U.S. Appl. No. 16/649,177, filed Mar. 20, 2020.
Co-pending U.S. Appl. No. 16/764,330, filed May 14, 2020.
Co-Pending U.S. Appl. No. 16/784,208, filed Feb. 6, 2020.
Co-Pending U.S. Appl. No. 16/793,995, filed Feb. 18, 2020.
Co-Pending U.S. Appl. No. 16/814,900, filed Mar. 11, 2020.
Co-Pending U.S. Appl. No. 16/850,229, filed Apr. 16, 2020.
Co-Pending U.S. Appl. No. 16/883,617, filed May 26, 2020.
DE102010060999 Machine Translation (by EPO and Google)—published Jun. 6, 2012; Wolf, Roland, Dr.-lng.
Epomin Polyment, product information from Nippon Shokubai, dated Feb. 28, 2014.
Flexicon., "Bulk Handling Equipment and Systems: Carbon Black," 2018, 2 pages.
Handbook of Print Media, 2001, Springer Verlag, Berlin/Heidelberg/New York, pp. 127-136,748—With English Translation.
IP.com Search, 2018, 2 pages.
IP.com Search, 2019, 1 page.
JP2000108320 Machine Translation (by PlatPat English machine translation)—published Apr. 18, 2000 Brother Ind. Ltd.
JP2000108334A Machine Translation (by EPO and Google)—published Apr. 18, 2000; Brother Ind Ltd.
JP2000141710A Machine Translation (by EPO and Google)—published May 23, 2000; Brother Ind Ltd.
JP2000168062A Machine Translation (by EPO and Google)—published Jun. 20, 2000; Brother Ind Ltd.
JP2000169772 Machine Translation (by EPO and Google)—published Jun. 20, 2000; Tokyo Ink MFG Co Ltd.
JP2000206801 Machine Translation (by PlatPat English machine translation); published on Jul. 28, 2000, Canon KK, Kobayashi et al.
JP2001088430A Machine Translation (by EPO and Google)—published Apr. 3, 2001; Kimoto KK.
JP2001098201A Machine Translation (by EPO and Google)—published Apr. 10, 2001; Eastman Kodak Co.
JP2001139865A Machine Translation (by EPO and Google)—published May 22, 2001; Sharp KK.
JP2001164165A Machine Translation (by EPO and Google)—published Jun. 19, 2001; Dainippon Ink & Chemicals.
JP2001199150A Machine Translation (by EPO and Google)—published Jul. 24, 2001; Canon KK.
JP2001206522 Machine Translation (by EPO, PlatPat and Google)—published Jul. 31, 2001; Nitto Denko Corp, Kato et al.
JP2002069346A Machine Translation (by EPO and Google)—published Mar. 8, 2002; Dainippon Ink & Chemicals.
JP2002103598A Machine Translation (by EPO and Google)—published Apr. 9, 2002; Olympus Optical Co.
JP2002169383 Machine Translation (by EPO, PlatPat and Google)—published Jun. 14, 2002 Richo KK.
JP2002234243 Machine Translation (by EPO and Google)—published Aug. 20, 2002; Hitachi Koki Co Ltd.
JP2002278365 Machine Translation (by PlatPat English machine translation)—published Sep. 27, 2002 Katsuaki, Ricoh KK.
JP2002304066A Machine Translation (by EPO and Google)—published Oct. 18, 2002; PFU Ltd.
JP2002326733 Machine Translation (by EPO, PlatPat and Google)—published Nov. 12, 2002; Kyocera Mita Corp.
JP2002371208 Machine Translation (by EPO and Google)—published Dec. 26, 2002; Canon Inc.

(56) References Cited

OTHER PUBLICATIONS

JP2003114558 Machine Translation (by EPO, PlatPat and Google)—published Apr. 18, 2003 Mitsubishi Chem Corp, Yuka Denshi Co Ltd, et al.
JP2003145914A Machine Translation (by EPO and Google)—published May 21, 2003; Konishiroku Photo Ind.
JP2003211770 Machine Translation (by EPO and Google)—published Jul. 29, 2003 Hitachi Printing Solutions.
JP2003219271 Machine Translation (by EPO and Google); published on Jul. 31, 2003, Japan Broadcasting.
JP2003246135 Machine Translation (by PlatPat English machine translation)—published Sep. 2, 2003 Ricoh KK, Morohoshi et al.
JP2003246484 Machine Translation (English machine translation)—published Sep. 2, 2003 Kyocera Corp.
JP2003292855A Machine Translation (by EPO and Google)—published Oct. 15, 2003; Konishiroku Photo Ind.
JP2003313466A Machine Translation (by EPO and Google)—published Nov. 6, 2003; Ricoh KK.
JP2004009632A Machine Translation (by EPO and Google)—published Jan. 15, 2004; Konica Minolta Holdings Inc.
JP2004019022 Machine Translation (by EPO and Google)—published Jan. 22, 2004; Yamano et al.
JP2004025708A Machine Translation (by EPO and Google)—published Jan. 29, 2004; Konica Minolta Holdings Inc.
JP2004034441A Machine Translation (by EPO and Google)—published Feb. 5, 2004; Konica Minolta Holdings Inc.
JP2004077669 Machine Translation (by PlatPat English machine translation)—published Mar. 11, 2004 Fuji Xerox Co Ltd.
JP2004114377(A) Machine Translation (by EPO and Google)—published Apr. 15, 2004; Konica Minolta Holdings Inc, et al.
JP2004114675 Machine Translation (by EPO and Google)—published Apr. 15, 2004; Canon Inc.
JP2004148687A Machine Translation (by EPO and Google)—published May 27, 2014; Mitsubishi Heavy Ind Ltd.
JP2004231711 Machine Translation (by EPO and Google)—published Aug. 19, 2004; Seiko Epson Corp.
JP2004261975 Machine Translation (by EPO, PlatPat and Google); published on Sep. 24, 2004, Seiko Epson Corp, Kataoka et al.
JP2004325782A Machine Translation (by EPO and Google)—published Nov. 18, 2004; Canon KK.
JP2004524190A Machine Translation (by EPO and Google)—published Aug. 12, 2004; Avery Dennison Corp.
JP2005014255 Machine Translation (by EPO and Google)—published Jan. 20, 2005; Canon Inc.
JP2005014256 Machine Translation (by EPO and Google)—published Jan. 20, 2005; Canon Inc.
JP2005114769 Machine Translation (by PlatPat English machine translation)—published Apr. 28, 2005 Ricoh KK.
JP2005215247A Machine Translation (by EPO and Google)—published Aug. 11, 2005; Toshiba Corp.
JP2005319593 Machine Translation (by EPO and Google)—published Nov. 17, 2005, Jujo Paper Co Ltd.
JP2006001688 Machine Translation (by PlatPat English machine translation)—published Jan. 5, 2006 Ricoh KK.
JP2006023403A Machine Translation (by EPO and Google)—published Jan. 26, 2006; Ricoh KK.
JP2006095870A Machine Translation (by EPO and Google)—published Apr. 13, 2006; Fuji Photo Film Co Ltd.
JP2006102975 Machine Translation (by EPO and Google)—published Apr. 20, 2006; Fuji Photo Film Co Ltd.
JP2006137127 Machine Translation (by EPO and Google)—published Jun. 1, 2006; Konica Minolta Med & Graphic.
JP2006143778 Machine Translation (by EPO, PlatPat and Google)—published Jun. 8, 2006 Sun Bijutsu Insatsu KK et al.
JP2006152133 Machine Translation (by EPO, PlatPat and Google)—published Jun. 15, 2006 Seiko Epson Corp.
JP2006224583A Machine Translation (by EPO and Google)—published Aug. 31, 2006; Konica Minolta Holdings Inc.
JP2006231666A Machine Translation (by EPO and Google)—published Sep. 7, 2006; Seiko Epson Corp.
JP2006234212A Machine Translation (by EPO and Google)—published Sep. 7, 2006; Matsushita Electric Ind Co Ltd.
JP2006243212 Machine Translation (by PlatPat English machine translation)—published Sep. 14, 2006 Fuji Xerox Co Ltd.
JP2006263984 Machine Translation (by EPO, PlatPat and Google)—published Oct. 5, 2006 Fuji Photo Film Co Ltd.
JP2006347081 Machine Translation (by EPO and Google)—published Dec. 28, 2006; Fuji Xerox Co Ltd.
JP2006347085 Machine Translation (by EPO and Google)—published Dec. 28, 2006 Fuji Xerox Co Ltd.
JP2007025246A Machine Translation (by EPO and Google)—published Feb. 1, 2007; Seiko Epson Corp.
JP2007041530A Machine Translation (by EPO and Google)—published Feb. 15, 2007; Fuji Xerox Co Ltd.
JP2007069584 Machine Translation (by EPO and Google)—published Mar. 22, 2007 Fujifilm.
JP2007083445A Machine Translation (by EPO and Google)—published Apr. 5, 2007; Fujifilm Corp.
JP2011144271 Machine Translation (by EPO and Google)—published Jun. 28, 2011 Toyo Ink SC Holdings Co Ltd.
JP2011173325 Abstract; Machine Translation (by EPO and Google)—published Sep. 8, 2011; Canon Inc.
JP2011173326 Machine Translation (by EPO and Google)—published Sep. 8, 2011; Canon Inc.
JP2011186346 Machine Translation (by PlatPat English machine translation)—published Sep. 22, 2011 Seiko Epson Corp, Nishimura et al.
JP2011189627 Machine Translation (by Google Patents)—published Sep. 29, 2011; Canon KK.
JP2011201951A Machine Translation (by PlatPat English machine translation); published on Oct. 13, 2011, Shin-Etsu Chemical Co Ltd, Todoroki et al.
JP2011224032 Machine Translation (by EPO & Google)—published Jul. 5, 2012 Canon KK.
JP2012086499 Machine Translation (by EPO and Google)—published May 10, 2012; Canon Inc.
JP2012111194 Machine Translation (by EPO and Google)—published Jun. 14, 2012; Konica Minolta.
JP2012196787A Machine Translation (by EPO and Google)—published Oct. 18, 2012; Seiko Epson Corp.
JP2012201419A Machine Translation (by EPO and Google)—published Oct. 22, 2012, Seiko Epson Corp.
JP2013001081 Machine Translation (by EPO and Google)—published Jan. 7, 2013; Kao Corp.
JP2013060299 Machine Translation (by EPO and Google)—published Apr. 4, 2013; Ricoh Co Ltd.
JP2013103474 Machine Translation (by EPO and Google)—published May 30, 2013; Ricoh Co Ltd.
JP2013121671 Machine Translation (by EPO and Google)—published Jun. 20, 2013; Fuji Xerox Co Ltd.
JP2013129158 Machine Translation (by EPO and Google)—published Jul. 4, 2013; Fuji Xerox Co Ltd.
JP2014047005A Machine Translation (by EPO and Google)—published Mar. 17, 2014; Ricoh Co Ltd.
JP2014094827A Machine Translation (by EPO and Google)—published May 22, 2014; Panasonic Corp.
JP2016185688A Machine Translation (by EPO and Google)—published Oct. 27, 2016; Hitachi Industry Equipment Systems Co Ltd.
JP2529651B2 Machine Translation (by EPO and Google)—issued Aug. 28, 1996;Osaka Sealing Insatsu KK.
JPH03248170A Machine Translation (by EPO & Google)—published Nov. 6, 1991; Fujitsu Ltd.
JPH05147208 Machine Translation (by EPO and Google)—published Jun. 15, 1993—Mita Industrial Co Ltd.
JPH06100807 Machine Translation (by EPO and Google)—published Apr. 12, 1994; Seiko Instr Inc.
JPH06171076A Machine Translation (by PlatPat English machine translation)—published Jun. 21, 1994, Seiko Epson Corp.
JPH06345284A Machine Translation (by EPO and Google); published on Dec. 20, 1994, Seiko Epson Corp.
JPH06954A Machine Translation (by EPO and Google)—published Jan. 11, 1994; Seiko Epson Corp.

(56) References Cited

OTHER PUBLICATIONS

JPH07186453A Machine Translation (by EPO and Google)—published Jul. 25, 1995; Toshiba Corp.
JPH07238243A Machine Translation (by EPO and Google)—published Sep. 12, 1995; Seiko Instr Inc.
JPH08112970 Machine Translation (by EPO and Google)—published May 7, 1996; Fuji Photo Film Co Ltd.
JPH0862999A Machine Translation (by EPO & Google)—published Mar. 8, 1996 Toray Industries, Yoshida, Tomoyuki.
JPH09123432 Machine Translation (by EPO and Google)—published May 13, 1997, Mita Industrial Co Ltd.
JPH09157559A Machine Translation (by EPO and Google)—published Jun. 17, 1997; Toyo Ink Mfg Co.
JPH09281851A Machine Translation (by EPO and Google)—published Oct. 31, 1997; Seiko Epson Corp.
JPH09314867A Machine Translation (by PlatPat English machine translation)—published Dec. 9, 1997, Toshiba Corp.
JPH11106081A Machine Translation (by EPO and Google)—published Apr. 20, 1999; Ricoh KK.
JPH11245383A Machine Translation (by EPO and Google)—published Sep. 14, 1999; Xerox Corp.
JPH5297737 Machine Translation (by EPO & Google machine translation)—published Nov. 12, 1993 Fuji Xerox Co Ltd.
JPS5578904A Machine Translation (by EPO and Google)—published Jun. 14, 1980; Yokoyama Haruo.
JPS57121446U Machine Translation (by EPO and Google)—published Jul. 28, 1982.
JPS60199692A Machine Translation (by EPO and Google)—published Oct. 9, 1985; Suwa Seikosha KK.
JPS6076343A Machine Translation (by EPO and Google)—published Apr. 30, 1985; Toray Industries.
JPS6223783A Machine Translation (by EPO and Google)—published Jan. 31, 1987; Canon KK.
Machine Translation (by EPO and Google) of JPH07112841 published on May 2, 1995 Canon KK.
Marconi Studios, Virtual Set Real Time; http://www.marconistudios.il/pages/virtualset_en.php.
Montuori G.M., et al., "Geometrical Patterns for Diagrid Buildings: Exploring Alternative Design Strategies From the Structural Point of View," Engineering Structures, Jul. 2014, vol. 71, pp. 112-127.
"Solubility of Alcohol", in http://www.solubilityoflhings.com/water/alcohol; downloaded on Nov. 30, 2017.
Poly(vinyl acetate) data sheet. PolymerProcessing.com. Copyright 2010. http://polymerprocessing com/polymers/PVAC.html.
Royal Television Society, The Flight of the Phoenix; https://rts.org.uk/article/flight-phoenix, Jan. 27, 2011.
RU2180675C2 Machine Translation (by EPO and Google)—published Mar. 20, 2002; Zao Rezinotekhnika.
RU2282643C1 Machine Translation (by EPO and Google)—published Aug. 27, 2006; Balakovorezinotekhnika Aoot.
JP2007216673 Machine Translation (by EPO and Google)—published Aug. 30, 2007 Brother Ind.
JP2007253347A Machine Translation (by EPO and Google)—published Oct. 4, 2007; Ricoh KK, Matsuo et al.
JP2008006816 Machine Translation (by EPO and Google)—published Jan. 17, 2008; Fujifilm Corp.
JP2008018716 Machine Translation (by EPO and Google)—published Jan. 31, 2008; Canon Inc.
JP2008137239A Machine Translation (by EPO and Google); published on Jun. 19, 2008, Kyocera Mita Corp.
JP2008139877A Machine Translation (by EPO and Google)—published Jun. 19, 2008; Xerox Corp.
JP2008142962 Machine Translation (by EPO and Google)—published Jun. 26, 2008; Fuji Xerox Co Ltd.
JP2008183744A Machine Translation (by EPO and Google)—published Aug. 14, 2008, Fuji Xerox Co Ltd.
JP2008194997A Machine Translation (by EPO and Google)—published Aug. 28, 2008; Fuji Xerox Co Ltd.
JP2008201564 Machine Translation (English machine translation)—published Sep. 4, 2008 Fuji Xerox Co Ltd.
JP2008238674A Machine Translation (by EPO and Google)—published Oct. 9, 2008; Brother Ind Ltd.
JP2008246990 Machine Translation (by EPO and Google)—published Oct. 16, 2008, Jujo Paper Co Ltd.
JP2008254203A Machine Translation (by EPO and Google)—published Oct. 23, 2008; Fujifilm Corp.
JP2008255135 Machine Translation (by EPO and Google)—published Oct. 23, 2008; Fujifilm Corp.
JP2009045794 Machine Translation (by EPO and Google)—published Mar. 5, 2009; Fujifilm Corp.
JP2009045851A Machine Translation (by EPO and Google); published on Mar. 5, 2009, Fujifilm Corp.
JP2009045885A Machine Translation (by EPO and Google)—published Mar. 5, 2009; Fuji Xerox Co Ltd.
JP2009083314 Machine Translation (by EPO, PlatPat and Google)—published Apr. 23, 2009 Fujifilm Corp.
JP2009083317 Abstract; Machine Translation (by EPO and Google)—published Apr. 23, 2009; Fuji Film Corp.
JP2009083325 Abstract; Machine Translation (by EPO and Google)—published Apr. 23, 2009 Fujifilm.
JP2009096175 Machine Translation (EPO, PlatPat and Google) published on May 7, 2009 Fujifilm Corp.
JP2009148908A Machine Translation (by EPO and Google)—published Jul. 9, 2009; Fuji Xerox Co Ltd.
JP2009154330 Machine Translation (by EPO and Google)—published Jul. 16, 2009; Seiko Epson Corp.
JP2009190375 Machine Translation (by EPO and Google)—published Aug. 27, 2009; Fuji Xerox Co Ltd.
JP2009202355 Machine Translation (by EPO and Google)—published Sep. 10, 2009; Fuji Xerox Co Ltd.
JP2009214318 Machine Translation (by EPO and Google)—published Sep. 24, 2009 Fuji Xerox Co Ltd.
JP2009214439 Machine Translation (by PlatPat English machine translation)—published Sep. 24, 2009 Fujifilm Corp.
JP2009226852 Machine Translation (by EPO and Google)—published Oct. 8, 2009; Hirato Katsuyuki, Fujifilm Corp.
JP2009233977 Machine Translation (by EPO and Google)—published Oct. 15, 2009; Fuji Xerox Co Ltd.
JP2009234219 Machine Translation (by EPO and Google)—published Oct. 15, 2009; Fujifilm Corp.
JP2010054855 Machine Translation (by PlatPat English machine translation)—published Mar. 11, 2010 Itatsu, Fuji Xerox Co.
JP2010105365 Machine Translation (by EPO and Google)—published May 13, 2010; Fuji Xerox Co Ltd.
JP2010173201 Abstract; Machine Translation (by EPO and Google)—published Aug. 12, 2010; Richo Co Ltd.
JP2010184376 Machine Translation (by EPO, PlatPat and Google)—published Aug. 26, 2010 Fujifilm Corp.
JP2010214885A Machine Translation (by EPO and Google)—published Sep. 30, 2010; Mitsubishi Heavy Ind Ltd.
JP2010228192 Machine Translation (by PlatPat English machine translation)—published Oct. 14, 2010 Fuji Xerox.
JP2010228392A Machine Translation (by EPO and Google)—published Oct. 14, 2010; Jujo Paper Co Ltd.
JP2010234599A Machine Translation (by EPO and Google)—published Oct. 21, 2010; Duplo Seiko Corp et al.
JP2010234681A Machine Translation (by EPO and Google)—published Oct. 21, 2010; Riso Kagaku Corp.
JP2010241073 Machine Translation (by EPO and Google)—published Oct. 28, 2010; Canon Inc.
JP2010247381A Machine Translation (by EPO and Google); published on Nov. 4, 2010, Ricoh Co Ltd.
JP2010258193 Machine Translation (by EPO and Google)—published Nov. 11, 2010; Seiko Epson Corp.
JP2010260204A Machine Translation (by EPO and Google)—published Nov. 18, 2010; Canon KK.
JP2010260287 Machine Translation (by EPO and Google)—published Nov. 18, 2010, Canon KK.
JP2010260302A Machine Translation (by EPO and Google)—published Nov. 18, 2010; Riso Kagaku Corp.
JP2011002532 Machine Translation (by PlatPat English machine translation)—published Jun. 1, 2011 Seiko Epson Corp.

(56) References Cited

OTHER PUBLICATIONS

JP2011025431 Machine Translation (by EPO and Google)—published Feb. 10, 2011; Fuji Xerox Co Ltd.
JP2011037070A Machine Translation (by EPO and Google)—published Feb. 24, 2011; Riso Kagaku Corp.
JP2011067956A Machine Translation (by EPO and Google)—published Apr. 7, 2011; Fuji Xerox Co Ltd.
JP2011126031A Machine Translation (by EPO and Google); published on Jun. 30, 2011, Kao Corp.
CN102229294A Machine Translation (by EPO and Google)—published Nov. 2, 2011; Guangzhou Changcheng Ceramics Co Ltd.
CN102300932A Machine Translation (by EPO and Google)—published Dec. 28, 2011; Yoshida Hiroaki et al.
CN103568483A Machine Translation (by EPO and Google)—published Feb. 12, 2014; Anhui Printing Mechanical & Electrical Co Ltd.
CN103627337A Machine Translation (by EPO and Google)—published Mar. 12, 2014; Suzhou Banlid New Material Co Ltd.
CN107111267A Machine Translation (by EPO and Google)—published Aug. 29, 2017; Hewlett Packard Indigo BV.
CN1555422A Machine Translation (by EPO and Google)—published Dec. 15, 2004; Noranda Inc.
CN1680506A Machine Translation (by EPO and Google)—published Oct. 12, 2005; Shinetsu Chemical Co [JP].
Co-pending U.S. Appl. No. 17/155,121, filed Jan. 22, 2021.
Co-pending U.S. Appl. No. 17/265,817, inventors Alon; Siman Tov et al., filed Feb. 4, 2021.
Co-pending U.S. Appl. No. 17/279,539, inventors Helena; Chechik et al., filed Mar. 24, 2021.
Co-pending U.S. Appl. No. 17/312,394, filed Jun. 10, 2021.
Co-pending U.S. Appl. No. 17/382,285, filed Jul. 21, 2021.
Co-pending U.S. Appl. No. 17/382,334, filed Jul. 21, 2021.
Co-pending U.S. Appl. No. 17/414,087, filed Jun. 15, 2021.
IP.com search (Year: 2021).
JP2000343025A Machine Translation (by EPO and Google)—published Dec. 12, 2000; Kyocera Corp.
JP2002049211A Machine Translation (by EPO and Google)—published Feb. 15, 2002; PFU Ltd.
JP2003094795A Machine Translation (by EPO and Google)—published Apr. 3, 2003; Ricoh KK.
JP2004011263A Machine Translation (by EPO and Google)—published Jan. 15, 2004; Sumitomo Denko Steel Wire KK.
JP2004167902A Machine Translation (by EPO and Google)—published Jun. 17, 2004; Nippon New Chrome KK.
JP2004340983A Machine Translation (by EPO and Google)—published Dec. 2, 2004; Ricoh KK.
JP2007079159A Machine Translation (by EPO and Google)—published Mar. 29, 2007; Ricoh KK.
JP2008137146A Machine Translation (by EPO and Google)—published Jun. 19, 2008; CBG Acciai SRL.
JP2009226805A Machine Translation (by EPO and Google)—published Oct. 8, 2009; Fuji Xerox Co Ltd.
JP2009226890A Machine Translation (by EPO and Google)—published Oct. 8, 2009; Fuji Xerox Co Ltd.
JP2010240897A Machine Translation (by EPO and Google)—published Oct. 28, 2010; Toppan Printing Co Ltd.
JP2011031619A Machine Translation (by EPO and Google)—published Feb. 17, 2011; Xerox Corp.
JP2014131843A Machine Translation (by EPO and Google)—published Jul. 17, 2014; Ricoh Co Ltd.
JP2016093999A Machine Translation (by EPO and Google)—published May 26, 2016; Canon KK.
JPH09300678A Machine Translation (by EPO and Google)—published Nov. 25, 1997; Mitsubishi Electric Corp.
JPH11138740A Machine Translation (by EPO and Google)—published May 25, 1999; Nikka KK.
Larostat 264 A Quaternary Ammonium Compound, Technical Bulletin, BASF Corporation, Dec. 2002, p. 1.
CN101592896A Machine Translation (by EPO and Google)—published Dec. 2, 2009; Canon KK.
CN101820241A Machine Translation (by EPO and Google)—published Sep. 1, 2010; Canon KK.
CN102529257A Machine Translation (by EPO and Google)—published Jul. 4, 2012; Nippon Synthetic Chem Ind.
CN102673209A Machine Translation (by EPO and Google)—published Sep. 19, 2012; Wistron Corp.
CN104015415A Machine Translation (by EPO and Google)—published Sep. 3, 2014; Avery Dennison Dorp.
CN1305895A Machine Translation (by EPO and Google)—published Aug. 1, 2001; Imaje SA [FR].
CN1543404A Machine Translation (by EPO and Google)—published Nov. 3, 2004; 3M Innovative Properties Co [US].
CN1703326A Machine Translation (by EPO and Google)—published Nov. 30, 2005; Nissha Printing [JP].
Co-Pending U.S. Appl. No. 17/438,497, inventors Helena; Chechik et al., filed Sep. 13, 2021.
Co-Pending U.S. Appl. No. 17/583,372, inventor Pomerantz; Uriel, filed Jan. 25, 2022.
Co-Pending U.S. Appl. No. 17/676,398, filed Mar. 21, 2022.
Co-Pending U.S. Appl. No. 17/694,702, inventor Chechik; Helena, filed Mar. 15, 2022.
Co-Pending U.S. Appl. No. 17/712,198, filed Apr. 4, 2022.
Co-Pending U.S. Appl. No. 17/773,609, filed May 1, 2022.
JP2003076159A Machine Translation (by EPO and Google)—published Mar. 14, 2003, Ricoh KK.
JP2008082820A Machine Translation (by EPO and Google)—published Apr. 10, 2008; Ricoh KK.
JP2009227909A Machine Translation (EPO, PlatPat and Google) published on Oct. 8, 2009 Fujifilm Corp.
JP2009240925A Machine Translation (by EPO and Google)—published Oct. 22, 2009; Fujifilm Corp.
JP2009271422A Machine Translation (by EPO and Google)—published Nov. 19, 2009; Ricoh KK.
JP2009532240A Machine Translation (by EPO and Google)—published Sep. 10, 2009; Aisapack Holding SA.
JP2010030300A Machine Translation (by EPO and Google)—published Feb. 12, 2010; Xerox Corp.
JP2011064850A Machine Translation (by EPO and Google)—published Mar. 31, 2011; Seiko Epson Corp.
JP2011168024A Machine Translation (EPO, PlatPat and Google) published on Sep. 1, 2011 Ricoh Co Ltd.
JP2013104044A Machine Translation (by EPO and Google)—published May 30, 2013; Three M Innovative Properties.
JP2014008609A Machine Translation (EPO, PlatPat and Google) published on Jan. 20, 2014 Seiko Epson Corp.
JP2014073675A Machine Translation (EPO and Google) published on Apr. 24, 2014 Ricoh Co Ltd.
JP2015202616A Machine Translation (EPO, PlatPat and Google) published on Nov. 16, 2015 Canon KK.
JP2016074206A Machine Translation (EPO and Google) published on May 12, 2016 Xerox Corp.
JP2017093178A Machine Translation (EPO and Google) published on May 25, 2017 Samsung Electronics Co Ltd.
JP4562388B2 Machine Translation (by EPO and Google)—published Oct. 13, 2010; SK Kaken Co Ltd.
JP48043941 Machine Translation (by EPO and Google)—published Dec. 21, 1973;. Ibaraki.
JPH10130597A Machine Translation (by EPO and Google)—published May 19, 1998; Sekisui Chemical Co Ltd.
XIAMETER™ "OFS-0777 Siliconate Technical Data Sheet," Dec. 31, 2017, 5 pages. [Retrieved from the internet on Oct. 13, 2021]: https://www.dow.com/en-us/document-viewer.html?ramdomVar=6236427586842315077&docPath=/content/dam/dcc/documents/en-us/productdatasheet/95/95-4/95-435-01-xiameter-ofs-0777-siliconate.pdf.
Technical Information Lupasol Types, Sep. 2010, 10 pages.
The Engineering Toolbox., "Dynamic Viscosity of Common Liquids," 2018, 4 pages.
Thomas E. F., "CRC Handbook of Food Additives, Second Edition, vol. 1" CRC Press LLC, 1972, p. 434.
Units of Viscosity published by Hydramotion Ltd 1 York Road Park, Malton, York Y017 6YA, England; downloaded from www.hydramotion.com website on Jun. 19, 2017.

(56) References Cited

OTHER PUBLICATIONS

WO2006051733A1 Machine Translation (by EPO and Google)—published May 18, 2006; Konica Minolta Med & Graphic.
WO2010073916A1 Machine Translation (by EPO and Google)—published Jul. 1,2 010; Nihon Parkerizing [JP] et al.
WO2013087249 Machine Translation (by EPO and Google)—published Jun. 20, 2013; Koenig & Bauer AG.

* cited by examiner

CALIBRATION OF RUNOUT ERROR IN A DIGITAL PRINTING SYSTEM

CROSS-REFERENCE TO RELATED APPLICATION

This application claims the benefit of U.S. Provisional Patent Application 62/590,672, filed Nov. 27, 2017, which is incorporated herein by reference.

FIELD OF THE INVENTION

The present invention relates generally to digital printing systems, and particularly to apparatus and methods for enhancing the precision of digital printing.

BACKGROUND

Some digital printing systems use a flexible, moving intermediate transfer member (ITM), referred to herein as a "blanket." A system of this sort is described, for example in PCT International Publication WO 2013/132424, whose disclosure is incorporated herein by reference. An ink image is formed on a surface of the moving ITM (for example, by droplet deposition at an image forming station) and subsequently transferred to a substrate, such as a sheet or roll of paper or plastic (at a transfer station). To transfer the ink image to the substrate, the substrate is pressed between at least one impression cylinder and a region of the moving ITM where the ink image is located.

High-quality printing requires precise registration between the droplet deposition heads and the moving medium onto which the ink image is formed. One of the problems that can lead to misregistration is "runout" of a roller over which the medium passes, meaning that the signal output by an encoder monitoring the roller has a period error due to deviation of the roller from true circular rotation.

U.S. Pat. No. 8,162,428 describes a method that compensates for runout errors in a web printing system. The method includes identifying runout error at a first roller driving a web of printable media, generating a runout compensation value corresponding to the identified runout error, identifying a velocity of the moving web with reference to encoder output corresponding to an angular velocity of the first roller and the generated runout compensation value, and delivering a firing signal to a print head proximate the first roller to energize the inkjet nozzles in the print head and eject ink onto the web at a position corresponding to the computed web velocity.

SUMMARY

Embodiments of the present invention that are described hereinbelow provide methods and apparatus for enhancing the precision of a digital printing system.

There is therefore provided, in accordance with an embodiment of the invention, printing apparatus, including a continuous blanket and a set of motorized rollers, which are coupled to advance the blanket at a constant speed through an image area of the apparatus. One or more print bars are configured to eject droplets of ink at respective locations onto the blanket in the image area so as to create an image. One or more monitoring rollers are positioned in proximity to the respective locations of the print bars and contact the blanket so as to be rotated by advancement of the blanket. Each monitoring roller includes an encoder configured to output a signal indicative of a rotation angle of the monitoring roller. A control unit is configured to collect, during a calibration phase, the signal from the encoder in each of the monitoring rollers over multiple rotations of the monitoring rollers while the blanket is advanced at the constant speed through the image area and to compute runout correction factors for the monitoring rollers responsively to the collected signal, and is further configured to synchronize, during an operational phase subsequent to the calibration phase, ejection of the droplets from the print bars using the computed runout correction factors.

In some embodiments, the one or more print bars comprise a first plurality of the print bars, and the one or more monitoring rollers comprise a second plurality of the monitoring rollers. In a disclosed embodiment, the plurality of print bars are configured to eject the ink of different, respective colors, and the control unit is configured to synchronize the ejection of the droplets with the advancement of the blanket so as to register the different colors in the image. Additionally or alternatively, the apparatus includes a transfer station, which is configured to transfer the image from the blanket to a print medium.

In some embodiments, the control unit is configured, during the calibration phase, to detect a deviation of the signal from the encoder relative to a clock signal having a predefined frequency, and to apply the runout correction factors in synchronizing the ejection of the droplets to the clock signal. In a disclosed embodiment, the control unit is configured to derive from the signal output by the encoder a sequence of ticks at a predefined angular separation, and to sample the signal synchronously with the ticks and to measure, based on the clock signal, variations in a time elapsed between the ticks.

Typically, the control unit is configured to compute and apply the runout correction factors as a function of an angle of rotation of each of the monitoring rollers. In some embodiments, the control unit is configured to detect, based on the signal, variations in a speed of rotation of each of the monitoring rollers as a function of the angle of rotation and to compute the runout correction factors so as to compensate for the variations in the speed. In a disclosed embodiment, the runout correction factors for each monitoring roller are based on a ratio between an average speed of the rotation of the monitoring roller and a specific speed of rotation measured during the calibration phase in each of a multiplicity of angular sectors.

There is also provided, in accordance with an embodiment of the invention, a method for controlling a printer, which includes one or more print bars configured to eject droplets of ink at respective locations onto a moving blanket in an image area of the printer, thereby forming an image on the moving blanket. The method includes advancing the continuous blanket at a constant speed through the image area over one or more monitoring rollers, which are positioned in proximity to the respective locations of the print bars and contact the blanket so as to be rotated by advancement of the blanket, each monitoring roller including an encoder. A signal received from the encoder in each monitoring roller is indicative of a rotation angle of the monitoring roller. During a calibration phase, the signal is collected from the encoder in each of the monitoring rollers over multiple rotations of the monitoring rollers while the blanket is advanced at the constant speed through the image area. Runout correction factors are computed for the monitoring rollers responsively to the collected signal. During an operational phase subsequent to the calibration phase, ejection of the droplets from the print bars is synchronized using the computed runout correction factors.

There is additionally provided, in accordance with an embodiment of the invention, a printing system, including a continuous blanket and an image-forming station, which includes a set of motorized rollers, which are coupled to advance the blanket at a constant speed through an image area of the image-forming station. One or more print bars are configured to eject droplets of ink at respective locations onto the blanket in the image area so as to create an image on the blanket. One or more monitoring rollers are positioned in proximity to the respective locations of the print bars and contact the blanket so as to be rotated by advancement of the blanket. Each monitoring roller includes an encoder configured to output a signal indicative of a rotation angle of the monitoring roller. A transfer station is configured to transfer the image from the blanket to a print medium.

A control unit is configured to collect, during a calibration phase, the signal from the encoder in each of the one or more monitoring rollers over multiple rotations of the monitoring rollers while the blanket is advanced at the constant speed through the image area and to compute runout correction factors for the one or more monitoring rollers responsively to the collected signal. The controller is further configured to synchronize, during an operational phase subsequent to the calibration phase, ejection of the droplets from the one or more print bars using the computed runout correction factors.

There is further provided, in accordance with an embodiment of the invention, a method for controlling a printer, which includes advancing a continuous blanket at a constant speed through an image area of the printer over one or more monitoring rollers, which are positioned in proximity to respective locations of one or more print bars in the image area and contact the blanket so as to be rotated by advancement of the blanket. Each monitoring roller includes an encoder. A signal is received from the encoder in each monitoring roller indicative of a rotation angle of the monitoring roller. During a calibration phase, the signal from the encoder in each of the monitoring rollers is collected over multiple rotations of the monitoring rollers while the blanket is advanced at the constant speed through the image area. Runout correction factors are computed for the monitoring rollers responsively to the collected signal.

During an operational phase subsequent to the calibration phase, an image is formed on the blanket while advancing the blanket through the image area by ejecting droplets from the one or more print bars onto the blanket and synchronizing ejection of the droplets using the computed runout correction factors. The image is transferred from the blanket to a print medium. The present invention will be more fully understood from the following detailed description of the embodiments thereof, taken together with the drawings in which:

DETAILED DESCRIPTION OF EMBODIMENTS

Figure 1:
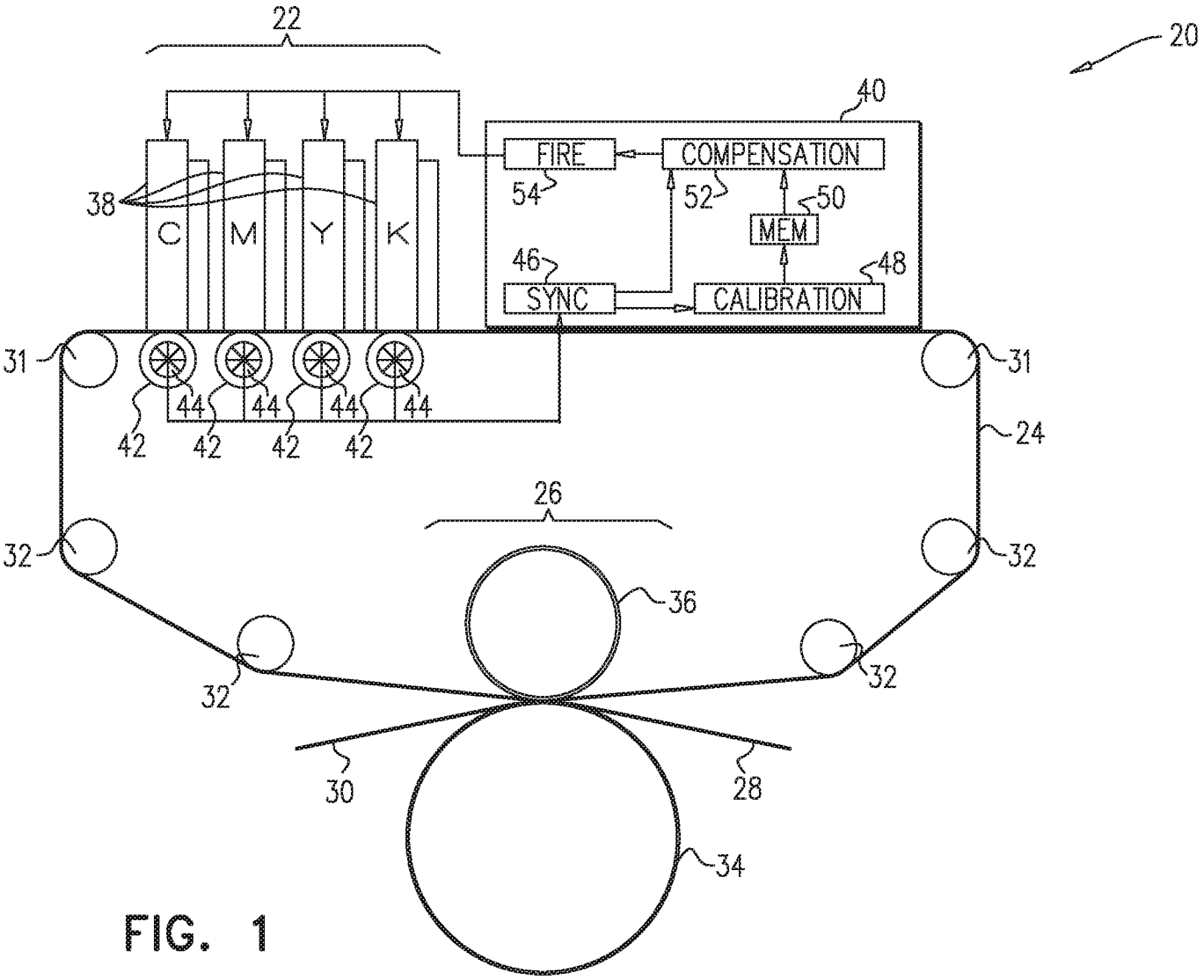
FIG. 1 is a schematic side view of a digital printing system, in accordance with an embodiment of the invention.

FIG. 1 is a schematic side view of a digital printing system 20, in accordance with an embodiment of the invention. This particular configuration of system 20 is shown by way of example, in order to illustrate certain problems that are addressed by embodiments of the present invention and to demonstrate the application of these embodiments in enhancing the performance of such a system. Embodiments of the present invention, however, are by no means limited to this specific sort of example system, and the principles described herein may similarly be applied to other sorts of printing systems that are known in the art.

System 20 comprises an image forming station 22, which creates an image on a continuous, moving blanket 24, and a transfer station 26, which transfers the image from the blanket to a print medium. Blanket 24 in this example comprises an endless belt, which is advanced over a set of rollers 31, 32, for example as described in the above-mentioned PCT International Publication PCT/IB2013/051727. In the pictured example, rollers 31 are motorized in order to drive blanket 24, and the print medium comprises sheets 28 of a suitable substrate, such as paper or plastic. Sheets 28 are captured and pressed against blanket 24 between an impression cylinder 34 and a pressure cylinder 36 (also referred to as a blanket cylinder), causing the image to be transferred from blanket 24 to output sheets 30. Alternatively, the print medium may comprise a continuous roll of material.

Image forming station 22 comprises multiple print bars 38, which eject droplets of ink at respective locations onto blanket 24, under the command of a control unit 40, so as to print images on the blanket that will be transferred to sheets 28 in transfer station 26. Typically, each print bar 38 comprise a plurality of print heads (not shown), which eject ink of a different, respective color from each print bar. The print bars are spaced apart along blanket 24 in the area of image forming station 22 (referred to herein as the image area of system 20), and control unit 40 synchronizes the ejection of the droplets with the advancement of the blanket by rollers 31 so as to register the different colors in the image. Although four print bars 38 are shown in FIG. 1 (for printing cyan, magenta, yellow and black inks, i.e., CMYK, respectively in the pictured example), image forming station 22 may alternatively comprise a smaller or larger number of print bars, in a different order.

To ensure that droplet ejection is properly synchronized, image forming station 22 comprises a set of monitoring rollers 42, which are positioned in proximity to the respective locations of print bars 38. In the pictured example, monitoring rollers 42 are positioned on the lower side of blanket 24, opposite the locations of print bars 38 on the upper side of the blanket. Further details of an arrangement of this sort are described, for example, in the PCT Patent Application PCT/IB2016/051560, whose disclosure is incorporated herein by reference. Alternatively, however, other arrangements of the monitoring rollers may be used. Monitoring rollers 42 contact blanket 24 so as to be rotated by advancement of the blanket.

Each monitoring roller 42 comprises an encoder 44, which outputs a signal indicative of a rotation angle of the monitoring roller. During the operational phase of system 20, control unit 40 receives these signals as an indication of the precise motion of blanket 24 relative to each of print bars 38 and synchronizes the ejection of the droplets from the print bars according to the signals.

As explained below, however, the indications of blanket position that are provided by encoders 44 can be distorted by a number of factors, including runout of monitoring rollers 42. Therefore, in embodiments of the present invention, control unit 40 calibrates and compensates for position errors that would otherwise by caused by such distortion. Specifically, during a calibration phase of system 20, prior to the operational phase, control unit 40 collects signals from encoders 44 over multiple rotations of monitoring rollers 42 while blanket 24 is advanced at a constant speed, and uses the collected signals in computing runout correction factors. In the subsequent operational phase, control unit 40 uses these runout correction factors in compensating for the runout of monitoring rollers 42 so as to synchronize the ejection of droplets from print bars 38 with high precision.

To carry out these functions, control unit 40 comprises a synchronizer 46, which samples the signals that are output by encoders 44. In the present embodiment, synchronizer 46 processes these signals to generate a respective sequence of "ticks" at predefined angular intervals of the rotation of each encoder 44. For example, synchronizer 46 may sense the rising and falling edges of the signals output by each encoder 44 to generate 40,000 ticks per revolution of the corresponding roller 42, as is known in the art. Because of runout of rollers 42 and other error factors, these ticks may not occur at constant, precisely-spaced time intervals. In order to measure and compensate for these error factors, synchronizer 46 samples the output signals from encoders 44, relative to a stable clock signal, synchronously with the ticks.

During the calibration phase in system 20, calibration logic 48 in control unit 40 measures the variations in the time elapsed between the ticks sampled by synchronizer 46 for each of encoders 44. Calibration logic 48 thus detects deviations of the signals from each encoder 44 relative to the clock signal, which has a constant, predefined frequency. The calibration logic applies these deviations in computing runout correction factors for each encoder 44, which are stored in a memory 50. Further details of this calibration process are described hereinbelow.

During subsequent printing operation of system 20, compensation logic 52 in control unit 40 reads the runout correction factors from memory 50 and uses these factors in determining when to issue "fire" signals to print bars 38, so as to compensate for the runout error in the timing of the ticks generated by synchronizer 46 in response to the signals output by encoders 44. In this manner, compensation logic 52 outputs instructions to a print bar drive circuit 54, indicating precisely the times at which the drive circuit should issue the "fire" signal to each of print bars 38 in order to precisely synchronize the ejection of the droplets to the clock signal, notwithstanding runout errors in rollers 42.

Control unit 40 typically comprises a general-purpose computer processor, which has suitable input and output interface and is programmed in software to carry out the functions that are described herein. Additionally or alternatively, at least some of the functions of control unit 40 are carried out by suitable hardware logic circuits, including high-speed timing, sampling, and signal generation circuits. These circuits may be implemented using hard-wired and/or programmable logic components. Although control unit 40 is shown in FIG. 1 as a unitary block, in practice the functions of the control unit may be distributed among multiple processors and circuits, which may be deployed at different locations in system 20. The term "control unit" in the present description and in the claims should be understood as covering these sorts of distributed implementations, as well.

Figure 2A:
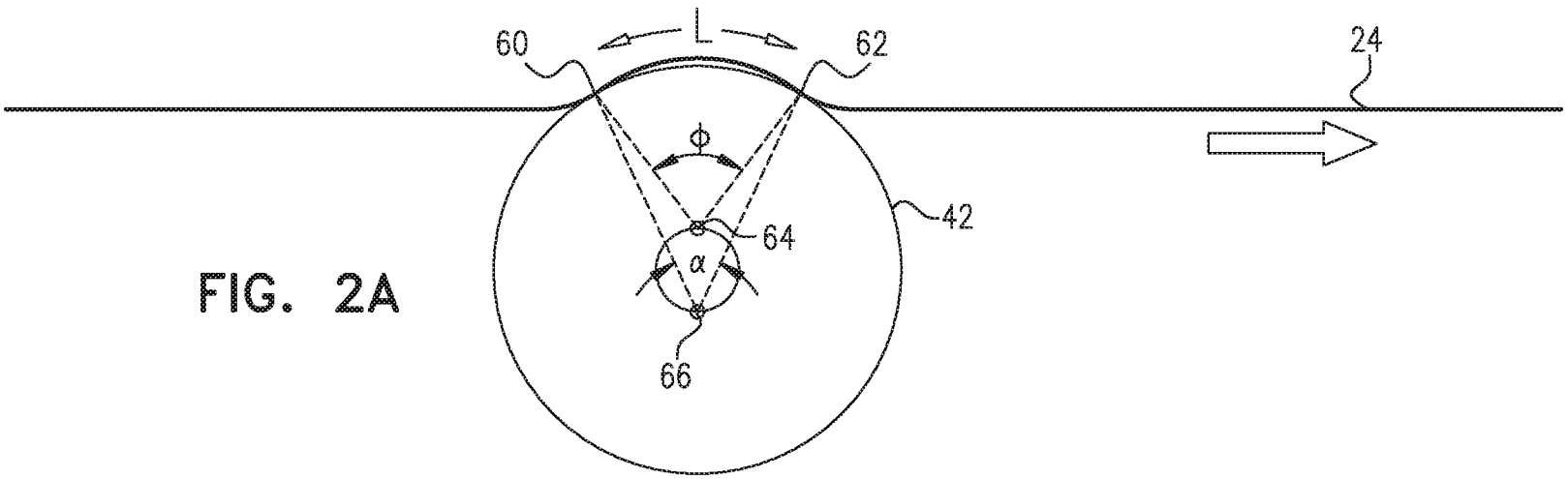
FIG. 2A is a schematic detail view of a roller and blanket in the system of FIG. 1.
Figure 2B:
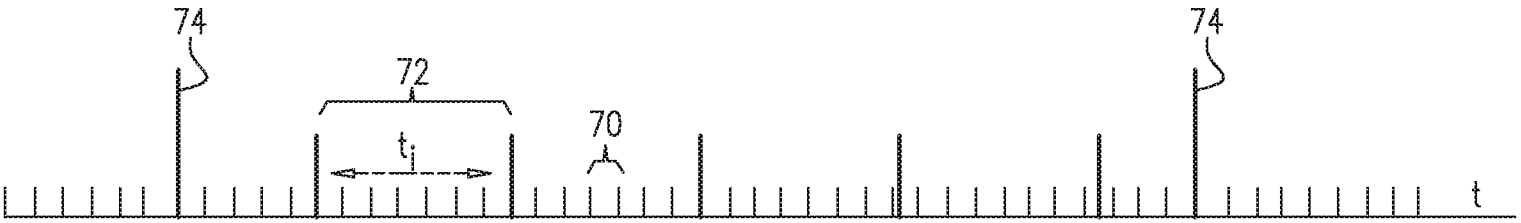
FIG. 2B is a timing diagram that schematically shows signals generated during operation of the system of FIG. 1.

Reference is now made to FIGS. 2A and 2B, which schematically illustrate a model of the operation of monitoring rollers 42 and encoders 44 that is used in generating runout correction factors, in accordance with an embodiment of the invention. FIG. 2A is a schematic detail view of monitoring roller 42 and blanket 24, while FIG. 2B is a timing diagram that schematically shows signals generated during operation of system 20. Although only a single roller 42 and the signals from the corresponding encoder 44 are illustrated in FIGS. 2A and 2B, control unit 40 uses the model illustrated in these figures in calibrating and compensating for runout in each of the rollers individually.

Roller 42 is assumed to have a diameter R and to engage blanket 24 between a pair of circumferential points 60 and 62, separated by a circumferential distance L. In the pictured example, the shaft of roller 42 is not rotating exactly in line with the intended axis, resulting in eccentric rotation, which is a form of runout. Runout error can also occur when roller 42 is slightly elliptical rather than circular in cross-section, or is mounted slightly off-center, or wobbles in some other manner, so that the effective radius of the roller varies with angle over each rotation. (Encoders 44 may also have small imperfections in their angular readings, with an effect that is similar to mechanical runout errors.) In general, each one of rollers 42 will have its own runout error, which is different in magnitude and angular dependence from those of the other rollers. These errors, if not corrected, lead to inaccuracy in the readings made by control unit 40 of the distance traversed by blanket 24 as it passes over each of rollers 42 and can thus affect the relative timing of the firing signals issued to print bars 38, resulting in misregistration in the printed images.

In the example shown in FIG. 2A, the axis of roller 42 wobbles cyclically over an elliptical path that includes an upper point 64 and a lower point 66, separated by a distance $\Delta R$. At upper point 64, the angular spread between circumferential points 60 and 62 is $\phi$, whereas at lower point 66 the angular spread has the smaller value $\alpha$. Although the circumferential distance L between points 60 and 62 is shown in FIG. 2A as though it were a constant value, in actuality it varies between $L_{MAX}=R*\varphi$ and $L_{MIN}=R*\alpha$, giving an encoder error of $0.5R(\varphi-\alpha)$. In terms of encoder 44 on roller 42, the elapsed number of ticks in rotation between points 60 and 62 about upper point 64 will be greater than the number of ticks in the rotation about lower point 66 by a multiplicative runout factor $$\delta = \frac{\Delta R}{R}.$$

As shown in FIG. 2B, control unit 40 uses a stabilized clock, having clock ticks separated by a clock cycle 70, which is typically much smaller than the interval between the encoder ticks. Synchronizer 46 meanwhile receives encoder ticks, which are separated by encoder intervals ($t_i$) 72, and reads the clock value at each tick. As explained above and illustrated in FIG. 2B, encoder intervals 72 vary due to runout of roller 42 (as well as other factors). Calibration logic 48 measures and models this variation and stores correction factors in memory 50, which are then applied by compensation logic 52 in generating fire pulses 74 to print bars 38 at the appropriate times.

Figure 3:
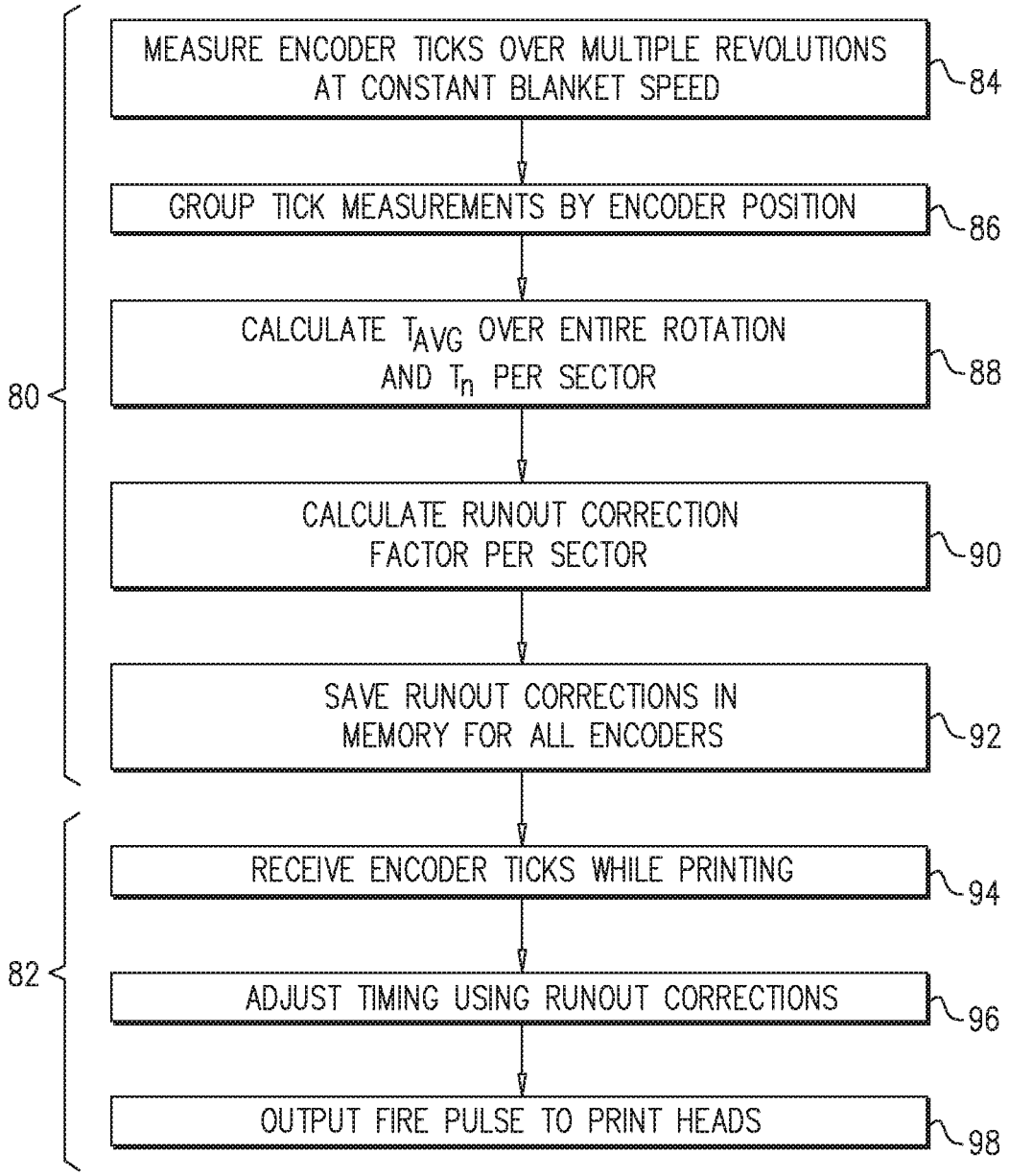
FIG. 3 is a flow chart that schematically shows a method for correction of runout error, in accordance with an embodiment of the invention.

FIG. 3 is a flow chart that schematically shows a method for correction of runout error, in accordance with an embodiment of the invention. Control unit 40 applies this method in order to compute and apply the appropriate runout correction factors as a function of an angle of rotation of each of monitoring rollers 42, as indicated by the corresponding encoders 44. The correction factors are derived by control unit 40 itself based on signals output by encoders 44 while running blanket 24. There is no need for any sort of specialized measurement tools or for test printing and analysis as part of the runout calibration process.

For the sake of concreteness and clarity, the method of FIG. 3 is described hereinbelow with reference to the elements of system 20. The principles of this method, however, are not limited to this particular system configuration and can be applied, mutatis mutandis, in other sorts of printing systems that require precise timing control with compensation for encoder error. In particular, although system 20 is shown in FIG. 1 as including four print bars 38, with four monitoring rollers 42 and encoders 44, the principles embodied in this system and in the present method may similarly be applied to printing system having larger or smaller numbers of print bars, monitoring rollers and corresponding encoders, including systems that include only a single print bar and/or a single monitoring roller and encoder. All such alternative embodiments are considered to be within the scope of the present invention.

The method of FIG. 3 is divided into two phases: a calibration phase 80, during which the runout correction factors are computed, and a subsequent operational phase 82, during which the corrections are applied. Calibration phase 80 is typically carried out before beginning the actual printing operation of system 20, and may be repeated at later times to compensate for changes in runout that can occur over time.

To start the calibration phase, synchronizer 46 samples and collects encoder ticks from each of encoders 44 over many rotations of rollers 42, while blanket 24 is advanced continuously at a constant speed, at a measurement step 84. It is advantageous that system 20 operate over sufficient time before beginning the measurements at step 84 in order to reach its normal operating temperature. When encoder measurements are made over many rotations under these conditions, temperature-related encoder errors will cancel out, as will various other possible errors due to transient speed variations of blanket 24, leaving only the runout errors to correct.

Each measurement made at step 84 gives the duration of encoder interval 72 for a given tick (in terms of clock cycles 70) at a given encoder position (i.e., a given angle of rotation). Calibration logic 48 groups these measurements as a function of position, at a measurement grouping step 86. For convenience of calibration, the 360° range of rotation angles can be divided into N angular sectors, for example N=32, and the encoder measurements grouped in each sector.

Based on the encoder measurements, calibration logic 48 computes an average sector tick duration $T_n$ for each sector n (n=1, . . . , N), as well as an average tick duration $T_{AVG}$ over all sectors, at an averaging step 88. As the average tick durations are inverse to the average velocities, this computation is equivalent to detecting, based on the encoder signals, variations in the circumferential speed of rotation V of each of monitoring rollers 42 as a function of the angle of rotation.

Calibration logic 48 then computes a runout correction factor $K_n$ for each sector so as to compensate for these variations in the circumferential speed, at a correction computation step 90. These runout correction factors for each monitoring roller 42 are based on the ratio between the average speed of the rotation of the monitoring roller and the specific speed of rotation measured during the calibration phase in each of the angular sectors, i.e., $$\frac{V_{AVG}}{V_n} = \frac{T_n}{T_{AVG}} = 1 + \delta = K_n$$

Calibration logic 48 saves the runout correction factors, per encoder and per sector, in memory 50, at a calibration storage step 92.

To begin operational phase 82, system 20 is loaded with sheets 28, and digital print images are fed to control unit 40, indicating which of print bars 38 should be fired at each pixel of the images. As blanket 24 advances and rollers 42 rotate, synchronizer 46 receives signals from encoders 44, at a tick input step 94. Compensation logic 52 identifies each tick with the angular sector to which it belongs and thus reads the appropriate correction factor $K_n$ from memory 50. Based on the correction factors, compensation logic 52 adjusts the measured tick interval, i.e., increases or decreases the interval by the factor $K_n$, thus effectively advancing or delaying the measured tick timing, in order to correct for the runout that was found in calibration phase 80, at a timing adjustment step 96. Compensation logic 52 inputs a signal to drive circuit 54 indicating the adjusted time, and drive circuit 54 accordingly outputs fire pulses to the appropriate print bars 38, at a firing step 98. This process continues over all encoder ticks and pixels printed by system until operation is complete.

It will be appreciated that the embodiments described above are cited by way of example, and that the present invention is not limited to what has been particularly shown and described hereinabove. Rather, the scope of the present invention includes both combinations and subcombinations of the various features described hereinabove, as well as variations and modifications thereof which would occur to persons skilled in the art upon reading the foregoing description and which are not disclosed in the prior art.

The invention claimed is:

1. Printing apparatus, comprising:

a continuous blanket;

a set of motorized rollers, which are coupled to advance the blanket at a constant speed through an image area of the apparatus;

one or more print bars, which are configured to eject droplets of ink at respective locations onto the blanket in the image area so as to create an image;

one or more monitoring rollers, which are positioned in proximity to the respective locations of the print bars and contact the blanket so as to be rotated by advancement of the blanket, each monitoring roller comprising an encoder configured to output a signal indicative of a rotation angle of the monitoring roller; and a control unit, which is configured to collect, during a calibration phase, the signal from the encoder in each of the one or more monitoring rollers over multiple rotations of the monitoring rollers while the blanket is advanced at the constant speed through the image area and to compute runout correction factors for the one or more monitoring rollers responsively to the collected signal, and which is further configured to synchronize, during an operational phase subsequent to the calibration phase, ejection of the droplets from the one or more print bars using the computed runout correction factors, wherein the control unit is configured to compute and apply the runout correction factors as a function of an angle of rotation of each of the one or more monitoring rollers, wherein the control unit is configured to detect, based on the signal, variations in a speed of rotation of each of the one or more monitoring rollers as a function of the angle of rotation and to compute the runout correction factors so as to compensate for the variations in the speed, and wherein the runout correction factors for each monitoring roller are based on a ratio between an average speed of the rotation of the monitoring roller and a specific speed of rotation measured during the calibration phase in each of a multiplicity of angular sectors.

2. The apparatus according to claim 1, wherein the one or more print bars comprise a first plurality of the print bars, and wherein the one or more monitoring rollers comprise a second plurality of the monitoring rollers.

3. The apparatus according to claim 2, wherein the first plurality of print bars are configured to eject the ink of different, respective colors, and wherein the control unit is configured to synchronize the ejection of the droplets with the advancement of the blanket so as to register the different colors in the image.

4. The apparatus according to claim 1, and comprising a transfer station, which is configured to transfer the image from the blanket to a print medium.

5. The apparatus according to claim 1, wherein the control unit is configured, during the calibration phase, to detect a deviation of the signal from the encoder relative to a clock signal having a predefined frequency, and to apply the runout correction factors in synchronizing the ejection of the droplets to the clock signal.

6. The apparatus according to claim 5, wherein the control unit is configured to derive from the signal output by the encoder a sequence of ticks at a predefined angular separation, and to sample the signal synchronously with the ticks and to measure, based on the clock signal, variations in a time elapsed between the ticks.

7. A method for controlling a printer, which includes a one or more print bars configured to eject droplets of ink at respective locations onto a moving blanket in an image area of the printer, thereby forming an image on the moving blanket, the method comprising:

advancing the continuous blanket at a constant speed through the image area over one or more monitoring rollers, which are positioned in proximity to the respective locations of the one or more print bars and contact the blanket so as to be rotated by advancement of the blanket, each monitoring roller comprising an encoder;

receiving a signal from the encoder in each monitoring roller indicative of a rotation angle of the monitoring roller;

during a calibration phase, collecting the signal from the encoder in each of the monitoring rollers over multiple rotations of the monitoring rollers while the blanket is advanced at the constant speed through the image area;

computing runout correction factors for the monitoring rollers responsively to the collected signal; and during an operational phase subsequent to the calibration phase, synchronizing ejection of the droplets from the print bars using the computed runout correction factors, wherein computing the runout correction factors comprises calculating the runout correction factors as a function of an angle of rotation of each of the monitoring rollers, wherein calculating the runout correction factors comprises detecting, based on the signal, variations in a speed of rotation of each of the one or more monitoring rollers as a function of the angle of rotation and computing the runout correction factors so as to compensate for the variations in the speed, and wherein the runout correction factors for each monitoring roller are based on a ratio between an average speed of the rotation of the monitoring roller and a specific speed of rotation measured during the calibration phase in each of a multiplicity of angular sectors.

8. The method according to claim 7, wherein the one or more print bars comprise a first plurality of the print bars, and wherein the one or more monitoring rollers comprise a second plurality of the monitoring rollers.

9. The method according to claim 8, wherein the first plurality of the print bars eject different, respective colors of the ink, and wherein synchronizing the ejection of the droplets comprises synchronizing the ejection with the advancement of the blanket so as to register the different colors in the image.

10. The method according to claim 7, and comprising transferring the image from the blanket to a print medium.

11. The method according to claim 7, wherein computing the runout correction factors comprises detecting a deviation of the signal from the encoder relative to a clock signal having a predefined frequency, and wherein synchronizing the ejection of the droplets comprises applying the runout correction factors in synchronizing the ejection of the droplets to the clock signal.

12. The method according to claim 11, wherein detecting the deviation comprises deriving from the signal output by the encoder a sequence of ticks at a predefined angular separation, sampling the signal synchronously with the ticks, and measuring, based on the clock signal, variations in a time elapsed between the ticks.

13. A printing system, comprising:

a continuous blanket;

an image-forming station, which comprises:

a set of motorized rollers, which are coupled to advance the blanket at a constant speed through an image area of the image-forming station;

one or more print bars, which are configured to eject droplets of ink at respective locations onto the blanket in the image area so as to create an image on the blanket; and one or more monitoring rollers, which are positioned in proximity to the respective locations of the print bars and contact the blanket so as to be rotated by advancement of the blanket, each monitoring roller comprising an encoder configured to output a signal indicative of a rotation angle of the monitoring roller;

a transfer station, which is configured to transfer the image from the blanket to a print medium; and a control unit, which is configured to collect, during a calibration phase, the signal from the encoder in each of the one or more monitoring rollers over multiple rotations of the monitoring rollers while the blanket is advanced at the constant speed through the image area and to compute runout correction factors for the one or more monitoring rollers responsively to the collected signal, and which is further configured to synchronize, during an operational phase subsequent to the calibration phase, ejection of the droplets from the one or more print bars using the computed runout correction factors, wherein the control unit is configured to compute and apply the runout correction factors as a function of an angle of rotation of each of the one or more monitoring rollers, wherein the control unit is configured to detect, based on the signal, variations in a speed of rotation of each of the one or more monitoring rollers as a function of the angle of rotation and to compute the runout correction factors so as to compensate for the variations in the speed, and wherein the runout correction factors for each monitoring roller are based on a ratio between an average speed of the rotation of the monitoring roller and a specific speed of rotation measured during the calibration phase in each of a multiplicity of angular sectors.

14. A method for controlling a printer, comprising:

advancing a continuous blanket at a constant speed through an image area of the printer over one or more monitoring rollers, which are positioned in proximity to respective locations of one or more print bars in the image area and contact the blanket so as to be rotated by advancement of the blanket, each monitoring roller comprising an encoder;

receiving a signal from the encoder in each monitoring roller indicative of a rotation angle of the monitoring roller;

during a calibration phase, collecting the signal from the encoder in each of the monitoring rollers over multiple rotations of the monitoring rollers while the blanket is advanced at the constant speed through the image area;

computing runout correction factors for the monitoring rollers responsively to the collected signal;

during an operational phase subsequent to the calibration phase, forming an image on the blanket while advancing the blanket through the image area by ejecting droplets from the one or more print bars onto the blanket and synchronizing ejection of the droplets using the computed runout correction factors; and transferring the image from the blanket to a print medium, wherein computing the runout correction factors comprises calculating the runout correction factors as a function of an angle of rotation of each of the monitoring rollers, wherein calculating the runout correction factors comprises detecting, based on the signal, variations in a speed of rotation of each of the one or more monitoring rollers as a function of the angle of rotation and computing the runout correction factors so as to compensate for the variations in the speed, and wherein the runout correction factors for each monitoring roller are based on a ratio between an average speed of the rotation of the monitoring roller and a specific speed of rotation measured during the calibration phase in each of a multiplicity of angular sectors.

* * * * *